United States Patent [19]

Clark et al.

[11] 3,962,597

[45] June 8, 1976

[54] GAS DISCHARGE DISPLAY PANEL INCLUDING ELECTRODE CONNECTIONS IN PLURALITY OF NON-CONDUCTIVE LAYERS

[75] Inventors: Kendall Clark, Poughkeepsie; Alan D. Lemberger, Wappinger Falls; Milton R. Shapiro, Poughkeepsie, all of N.Y.

[73] Assignee: International Business Machines Corporation, Armonk, N.Y.

[22] Filed: July 1, 1974

[21] Appl. No.: 484,647

[52] U.S. Cl. ..... 313/188; 313/201; 313/220; 313/318; 315/58

[51] Int. Cl.[2] ..... H01J 5/52; H01J 11/02; H01J 61/30; H01J 61/36

[58] Field of Search ..... 315/169 TV, 53, 58; 313/188, 220, 217, 318, 201

[56] References Cited

UNITED STATES PATENTS

| | | | |
|---|---|---|---|
| 3,739,218 | 6/1973 | Maloney | 315/169 TV X |
| 3,749,971 | 7/1973 | Petty | 315/169 TV |
| 3,765,011 | 10/1973 | Sawyer et al. | 315/169 TV X |
| 3,792,301 | 2/1974 | Kessler | 313/220 X |
| 3,806,760 | 4/1974 | Shimada | 315/169 TV |
| 3,846,656 | 11/1974 | Schermerhorn | 313/220 X |

*Primary Examiner*—Palmer C. Demeo
*Attorney, Agent, or Firm*—William J. Dick

[57] ABSTRACT

This patent discloses an improved gas discharge display panel typically of the type used for luminous displays showing lines of electrically changeable alphanumeric characters, figures and the like. The gas discharge display panel comprises a transparent front cover plate, a rear cover plate, and marginal sealing areas extending adjacent to and about the periphery of each of the plates.

The rear plate includes a plurality of contiguous layers of gas impervious material and electrical wiring intermediate the layers. Intermediate the plates is a thin flat chamber containing ionozable gas. Facing each other are a plurality of dielectrically coated electrodes mounted in the chamber, the electrodes of one group being mounted on the front plate at substantially right angles to but not contacting the electrodes of the second group mounted on the rear plate. To effect a localized ionization discharge of the gas, voltages are applied to electrically selected facing electrodes. The rear cover includes the wiring necessary for effecting such localized ionization and the one group of electrodes is electrically connected to the wiring of the rear cover in the marginal sealing areas between the front and rear covers.

27 Claims, 43 Drawing Figures

GAS DISCHARGE DISPLAY PANEL INCLUDING ELECTRODE CONNECTIONS IN PLURALITY OF NON-CONDUCTIVE LAYERS

SUMMARY OF THE INVENTION

The present invention relates to gas discharge display panels and more particularly relates to gas discharge display panels wherein in the preferred embodiment, the electronic components controlling the display maybe connected to the rear cover plate of the panel; and the electrical interconnection between the electronic components and the gas discharge electrodes of the gas discharge chamber are hermetically sealed within the multilayer rear cover plate and within the marginal sealing areas of the panel.

STATE OF THE PRIOR ART

Luminous displays of electrically changeable alphanumeric characters, figures, and the like have been an accepted means for displaying visible information for many years. Outdoor electric signs comprised of a matrix of individually switched electric light bulbs provide good examples of such older types of alpha-numeric displays. A common usage has been the lightbulb scoreboard at baseball and football games.

Recently large picture tubes in television sets have been used at airport terminals for luminous displays of flight arrivals and departures by using lines of alphanumeric characters. Another use has been the display of computer generated data. In such applications the picture tube display is remotely controlled by a computer which in turn is conveniently controlled by punch cards, magnetic tapes, or manual keyboard terminals. The picture tube has considerable utility in that 20 or more lines of characters may be displayed and the display may be quickly changed by remote computer control. The principle disadvantage is the large physical bulk of the television set housing which generally results in the set being mounted on a vertical surface or on a stand-alone pedestal. Smaller television sets are available but their housings are usually too large for convenient desk top or counter top use. Additionally, television sets are relatively expensive and maintenance costs for their high voltage electrical components are high.

More recently gas discharge display panels have become commercially available for displaying multiple lines of alpha-numeric characters. Such a display panel is usually mounted vertically on the front of a housing and the electronic components controlling the display panel are conventionally mounted on a separate chassis located in the rear of the housing. Pull-apart cable connectors engage multiple electrical terminals on the display panel and cables provide electrical interconnections to the electronic components. The physical bulk of the housing is about one half the bulk of a corresponding television set housing having an equivalent size display panel area; even so, such display panels are usually too large for convenient desk top or counter top use. For purposes of differentiation, this type of gas discharge display is hereinafter referred to as a first generation gas discharge display panel and the present invention is hereinafter referred to as a second generation gas discharge display panel.

In order to provide a better understanding of the advantages of the present invention, a brief description of a typical first generation gas discharge display panel is presented hereinafter.

In a typical configuration of a first generation gas discharge display panel, a rectangular front glass plate and a rectangular rear glass plate are assembled in superposed relation with their long axes at right angles to each other. A marginal sealing spacer is provided around the periphery of the overlapping areas of the glass plates and hermetically sealed to and between the glass plates. Interior to the marginal sealing area and between the glass plates is a thin flat chamber containing ionizable gas.

In order to provide ionization of the gas at selected places, a vertical array of parallel spaced apart electrodes is mounted to the inside of the front glass plate from top to bottom with electrical connections to the electrodes passing through the marginal hermetic seal and extending onto the non-overlapping top and bottom areas of the front plate to provide external electrical terminal connections. A multiple horizontal array of parallel, spaced apart electrodes, is mounted on the inside of the rear glass plate, with electrical connections to the electrodes passing through the marginal hermetic seal and extending onto the non-overlapping left and right areas of the rear plate to provide external electrical terminal connections. The external terminal connections are gold plated to provide good electrical contacts to gold plated spring contacts of pull-apart cable connectors and cables interconnect to electronic components mounted on a separate chassis in the rear of the housing.

Within the gas chamber the vertical and horizontal electrodes have a thin dielectric coating of glass and the construction is arranged such that the front-to-back spacing between the vertical glass coating and the horizontal glass coating is about 0.005 inch. When suitable high frequency alternating voltages are applied between selected vertical and horizontal electrodes the voltages cause voltage charges to appear on the surfaces of the dielectric glass at the selected intersections of the vertical and horizontal electrodes. The dielectric voltage charges discharge through the ionizable gas to create visible light at the selected intersections. The display panel has a hundred or more vertical and horizontal-conductors and by using computer logic to control the electronic components, voltages are applied at selected intersections whereby visible alpha-numeric characters, figures, etc. are initiated and maintained as a changeable display by the panel.

While the above described configuration has been convenient for low cost tooling and low volume production of first generation gas discharge display panels, recent production, cost, and sales experience has revealed numerous deficiencies.

The relatively large physical bulk of the panel housing is a sales disadvantage in locations such as bank teller cages, supermarket checkout counters, etc. where desk top or counter top space is at a premium. A first cause for the bulk is that the external panel terminals, cable connectors, and portions of the cables are all in the plane of the panel and outside the active display area; thus a relatively high and wide housing is required to enclose them. A second cause for the bulk is that the electronic components are on a separate chassis located in the rear of the housing; thus a relatively deep housing is required to enclose them.

Other problems with the first generation panel tend to effect reliability. For example, the hundred or more separable electrical connections between gold plated panel terminals and the gold plated spring contacts of the pull-apart cable connectors are a source of difficulties in that such connections occasionally fail to maintain electrical contact after the panel has been installed at the customers location. Other difficulties with terminals, cable connectors, and cables are that atmospheric moisture and corrosion occasionally cause electrical short circuits and open circuits. Additionally the cable connectors are expensive and particularly so for the gold plated external terminals and spring contacts.

Additional production and reliability difficulties are encountered with the hermetic seals where a hundred or more electrical connections to the internal gas discharge electrodes pass through the marginal seals to the external terminals. Microscopic air permeable pores frequently develop along the metal-to-glass hermetic seals during manufacturing and are difficult to detect. The porosity slowly admits atmospheric air into the low pressure gas chamber to shorten the useful life of the display panel.

As above set forth, the electronic components for controlling and providing voltages for the display are on a separate chassis. These chassis are subject to reliability difficulties because of moisture and corrosion that occasionally cause electrical short circuits and open circuits. Other difficulties arise from the large number of manual operations on the manufacturing line. The manual operators are not always consistent in the type of operations they perform and minor variations of such operations create, at least to a limited extent, a defective product.

OBJECTS OF THE INVENTION

In view of the above, it is a principal object of the present invention to provide a novel, integrally packaged, gas panel.

Another object of the present invention is to reduce the physical bulk of the housing for a gas discharge display panel.

Still another object of the present invention is to provide a novel gas display panel wherein electrical wiring and interconnections are located interior of a contiguous panel structure thereby eliminating external terminals, cable connections, and portions of cables in the plane of the panel that would require a larger housing to contain them.

Another object of the present invention is to further reduce the physical bulk of the panel housing by mounting the electronic components to the rear of the panel and within a cover hermetically sealed to the rear of the panel thereby eliminating a major portion of the space required within the housing for a separate chassis for the electronic components.

Another related object of the present invention is to provide a self-contained gas discharge display panel having a contiguous panel structure within a housing of a size sufficiently small as to be convenient for desk top and counter top usage.

A further object of the present invention is to improve panel reliability by hermetically sealing substantially all electrical wiring, interconnections, and electronic components interior of a panel structure thereby avoiding exposure to atmospheric moisture and corrosion.

Still another object of the present invention is to improve gas discharge display panel reliability by improving the sealing arrangement of the structure through inhibiting microscopic air permeable porosity along electrical connection seals that admit air to the gas chamber.

Yet another object of the present invention is to improve panel reliability by using a multilayer rear cover plate for the panel wherein substantially all of the electrical wiring and interconnections between the electronic components and the conductors of the gas discharge chamber are hermetically sealed within the multilayer rear cover plate.

A further object of the present invention includes a process for manufacturing an insulating structure which has hermetically sealed electrical interconnections within the marginal sealing area between gas ionizing electrical conductors on the inside of the front cover plate and the electrical wiring within the rear cover plate.

Another object of the present invention is to provide an alternate gas discharge display panel in which horizontal rows of discrete small area conductors are disposed and interconnected through the rear cover plate to horizontal conductors within the rear cover plate; the discrete small area conductors providing improved luminous definition.

A further object of the present invention is the use of exterior terminals for power supply and control signals that are hermetically sealed to the rear of the multilayer rear cover plate and are interconnected to electrical wiring in the interior of the rear cover plate.

Yet another object of the present invention is to provide a gas panel structure in which the rear multilayer plate houses conductors which are redundant with the electrodes of the gas panel whereby a break in an electrode will permit operation of the electrode to the break.

Other objects and a more complete understanding of the invention may be obtained with reference to the specification and claims taken in conjunction with the accompanying drawings in which:

FIGS. 1A, 1B and 1C are schematic perspective views illustrating different housing sizes for display panels that have the same active display areas;

FIG. 1A illustrating a television receiving set;

FIG. 1B showing a gas discharge display panel of a type currently being manufactured; and FIG. 1C illustrating a display panel constructed in accordance with the present invention;

Figure 14:
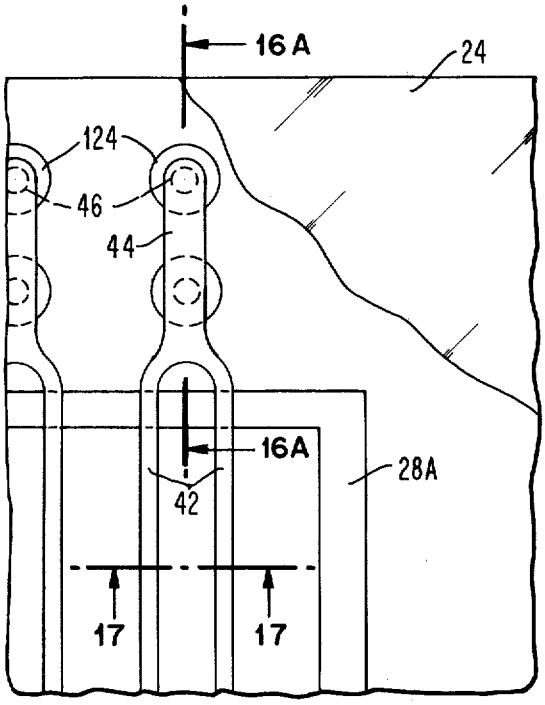
Figure 15:
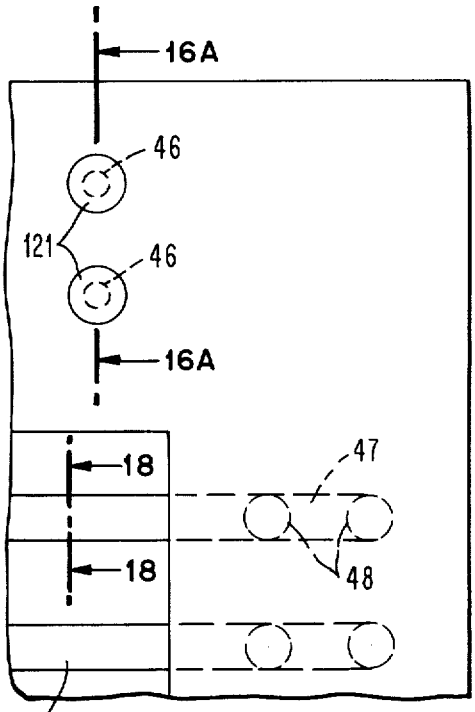
Figure 17:
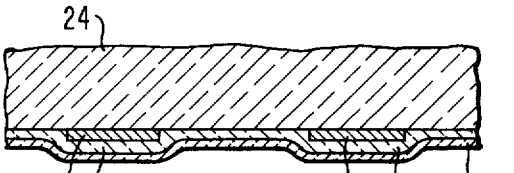
Figure 18:
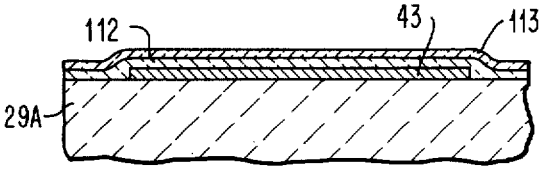
Figure 16A:
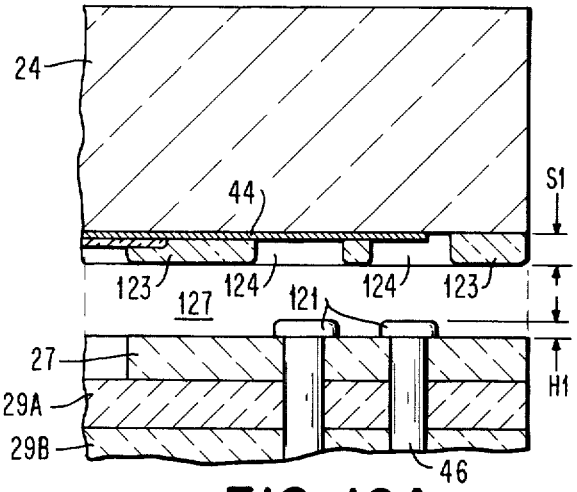
Figure 16B:
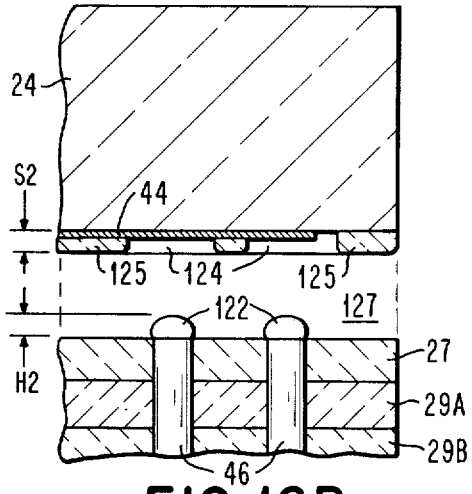
Figure 16C:
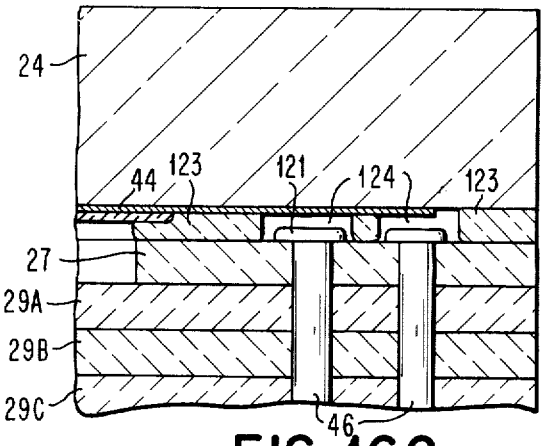
Figure 16D:
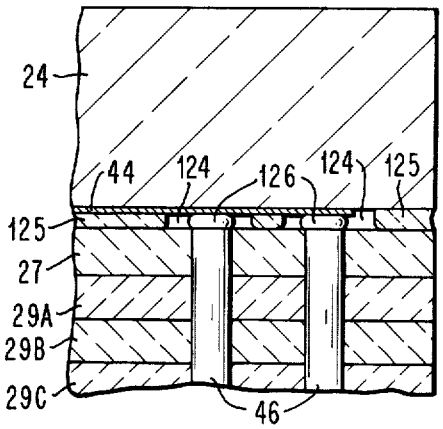
Figure 16E:
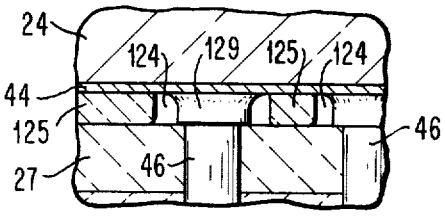

FIGS. 13A—13E are enlarged fragmentary sectional views illustrating electrical circuit wiring within the multilayer rear cover plate of a gas panel constructed in accordance with the present invention and showing interconnections between the pins, planar circuit conductors and circuit line conductors and connectors;

FIG. 14 is a fragmentary enlarged sectional view of a portion of the front cover plate and illustrating the registration of the front cover plate to the rear cover plate;

FIG. 15 is a fragmentary enlarged sectional view of the rear cover plate illustrating metallization over via hole conductors to make interconnections to vertical conductors on the front cover plate during the sealing of the front cover plate to the rear cover plate;

FIG. 16A is an enlarged fragmentary sectional view taken along lines 16A—16A of FIGS. 14 and 15 with the plates positioned and aligned for abutting relation;

FIG. 16B is a hypothetical enlarged fragmentary sectional view illustrating the physical changes that would occur if the plates of FIG. 16A were heated without contact thereof;

FIG. 16C is a enlarged fragmentary sectional view similar to FIG. 16A with the front and rear cover plates in abutting relationship prior to the sealing operation;

FIG. 16D is a fragmentary sectional view similar to FIG. 16C but illustrating the front and rear cover plate and conditions therein during the heating and sealing operation;

FIG. 16E is an enlarged fragmentary sectional view of a portion of the device illustrated in FIG. 16D and illustrating the liquid phase metallization material wetting the terminal ends of the electrodes;

FIG. 17 is an enlarged fragmentary sectional view illustrating the overcoating on the electrodes to inhibit sputtering disipation thereof by ionic bombardment; and FIG. 18 is a fragmentary sectional view similar to that of FIG. 17 but showing the overcoating on the electrodes of the rear plate.

GENERAL DESCRIPTION

Figure 1A:
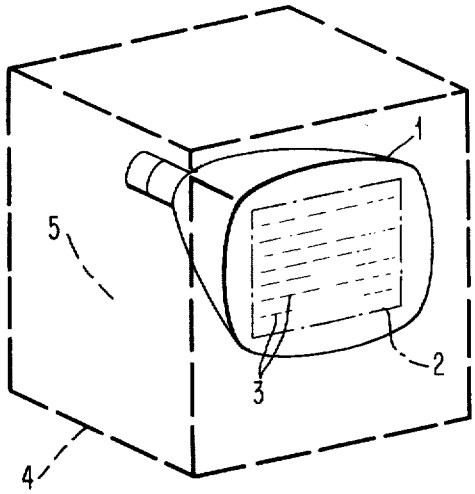
FIG. 1A PRIOR ART
Figure 1B:
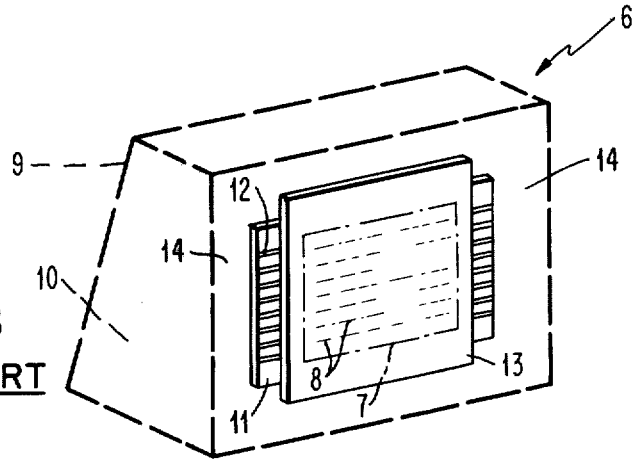
FIG. 1B PRIOR ART
Figure 1C:
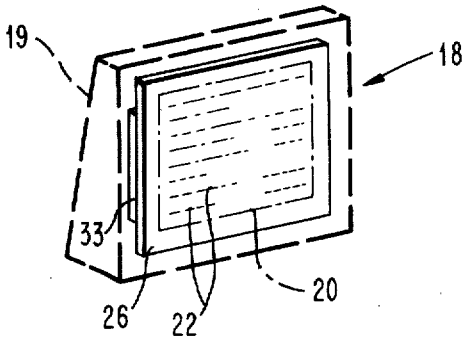

Referring now to the drawings, and particularly FIGS. 1A, 1B and 1C thereof, these FIGS. are drawn to approximately the same scale to illustrate the comparative size of housings for enclosing panels that display multiple lines of alpha-numeric characters. The panels of FIGS. 1A, 1B, and 1C each have an active display area approximately 5 × 7 inches. FIG. 1A shows as prior art, a small television picture tube 1 with an active display area 2 displaying multiple lines 3 of alpha-numeric characters. The television picture tube 1 has relatively large dimensions of height, width and depth and is enclosed within a relatively large housing 4. The rear of the housing 4 also encloses electronic components and a high voltage supply chassis in the space generally indicated by numeral 5.

FIG. 1B shows as prior art a gas discharge display panel 6 in a housing 9, the panel 6 being referred to herein as a first generation gas discharge display panel. The panel 6 has an active display area 7 displaying multiple lines 8 of alpha-numeric characters. The construction of the panel 6 is essentially planar with a relatively small depth dimension as compared to the depth of the television picture tube 1 of FIG. 1A. The panel 6 can thus be enclosed within the housing 9 of a smaller depth dimension than the housing 4 of the television tube 1. The rear of the housing 9 also encloses a separate chassis (not shown) having electrical and electronic components for controlling the display on the panel 6, with the separate chassis being in the space generally indicated by the numeral 10.

Using state of the art technology a first generation display panel 6 may be constructed with a portion of the panel 6 having horizontal panel extensions 11 and external terminal connections 12 thereon. A second portion of the panel 6 may be constructed having vertical panel extensions 13 and external terminal connections (not shown) on the rear surfaces of the vertical extensions. Snap-on terminal connectors (not shown) connect the horizontal terminals 12 and the vertical terminals to flat electrical cables that connect to the separate power and electronic driver chassis in the space 10 of the housing 9. The horizontal extensions 12 and vertical extensions 13 together with their associated snap-on cable connectors and portions of the flat electrical cables are essentially planar to the panel 6 and occupy additional horizontal and vertical planar spaces within the housing 9 such as are generally indicated by the numerals 14. The additional horizontal planar spaces 14 thus result in the housing 9 being somewhat wider than the housing 4 for the television picture tube 1 as shown in FIG. 1A.

FIG. 1C illustrates a smaller gas discharge display panel Assembly 18 constructed in accordance with the present invention and a consequently smaller size housing 19 therefor. When the panel Assembly 18 is constructed in accordance with the advanced technology and features of the invention, the Assembly 18 as described herein is referred to as a second generation gas discharge display panel. By comparison the display panels and housing shown in FIGS. 1A and 1B are considerably larger. However, in the illustrated instance the panel 18 has an active display area 20 approximately the same as the display areas 2 and 7 of FIGS. 1A and 1B, and includes a display of multiple lines 22 of alpha-numeric characters.

As will be explained in greater detail hereinafter, substantially all of the electrical connections for the assembly 18 are made internally through the marginal seal area 26 of the panel 18 to electrical circuit lines within a multilayer rear cover plate. Thus relative to FIG. 1B the horizontal panel extensions 12 and vertical panel extensions 13 are eliminated since they are not required for the external terminal connections. Likewise, substantially all snap-on cable connectors and cables are eliminated since the construction of the Assembly 18 provides equivalent electrical circuits within the internal structure of the Assembly 18. In aggregate, the elimination of the extensions, cable connectors, and cables by internal circuit structure of the Assembly 18 permits a substantial width reduction for the housing 19 relative to the housing 9 of FIG. 1B, and a consequent reduction in cost.

A hermetic rear cover 33 sealed to the multilayer rear cover plate of the Assembly 18 encloses electrical and electronic components that control the active display area 20 on the Assembly 18. The electrical and electronic components are assembled and connected to internal wiring within the multilayer rear cover plate as will be described subsequently. Thus the position of the electrical and electronic components on the rear of the multilayer rear cover plate eliminates most of the space 10 in FIG. 1B required for a separate chassis for the components thereby providing for a substantial depth reduction of the housing 19 relative to the housing 9 of FIG. 1B.

In summary, the construction features of Assembly 18 permit reduction in the size of the housing 19 relative to the housings of FIG. 1A and 1B. The reduction in size enhances the utility and market value of the display Assembly, particularly when used for instant credit reference purposes or in other instances, where desk top or counter top space is limited such as in bank tellers' cages and department store cash register cages.

DETAILED DESCRIPTION

Figure 2:
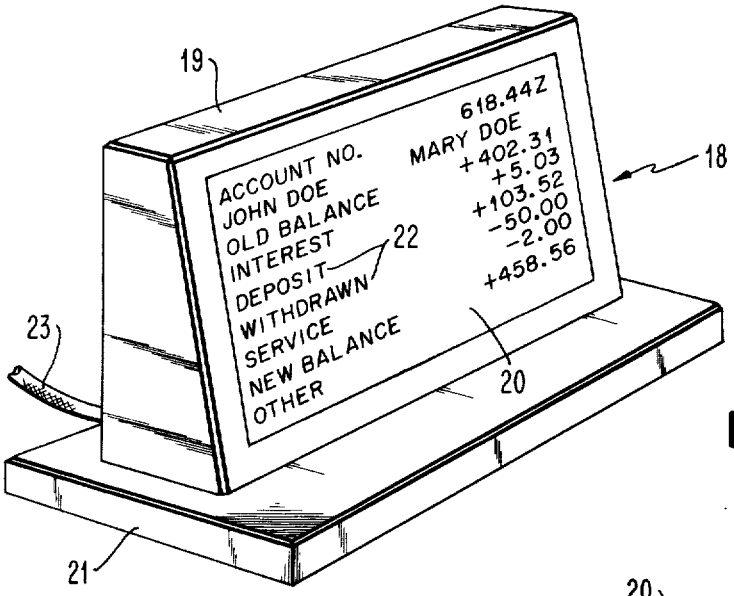
FIG. 2 is a fragmentary perspective view of a gas discharge display panel constructed in accordance with the present invention and mounted on a base.

For purposes of providing a better visualization of the gas discharge display panel as a marketable product, FIG. 2 shows a panel Assembly 18 constructed in accordance with the present invention. The Assembly 18 is shown mounted in a retaining frame and housing 19 for physical protection, the housing being supported in the illustrated instance, on a base 21 for stability against overturning. Typical lines 22 of luminous alpha-numeric characters are displayed on the active area 20 of the assembly. A cable 23 provides electrical signals and power to the panel assembly from, for example, a signal source such as a computer, and, if desired, the necessary power supply. It should be recognized that the power supply may be included within the housing 19, with consequent enlargement of the housing.

Figure 3A:
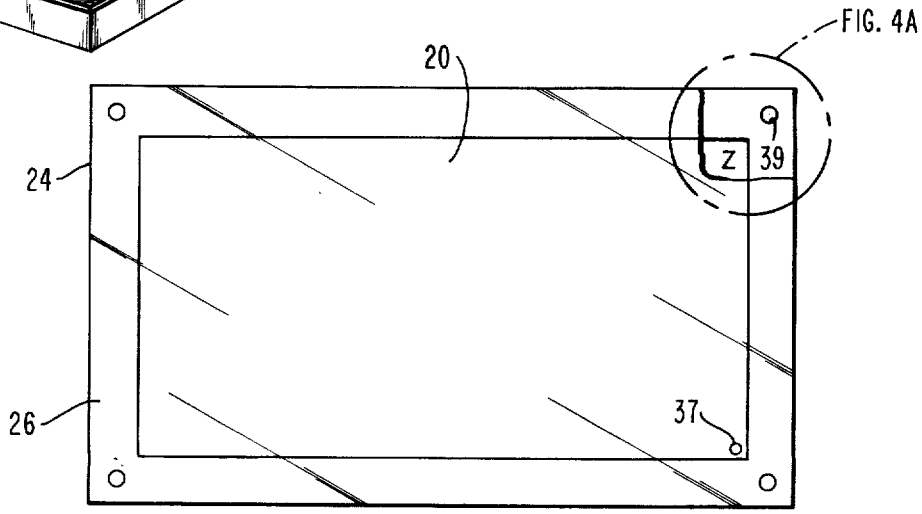
FIG. 3A is a frontal view of the display panel assembly shown in FIG. 2 with a single alpha-numeric character illustrated in one corner thereof.
Figure 3B:
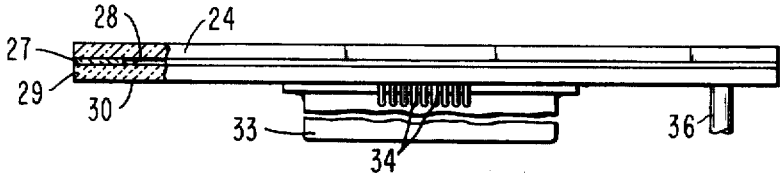
FIG. 3B is an edge view (bottom) of the gas discharge display panel assembly shown in FIG. 3A.
Figure 3C:
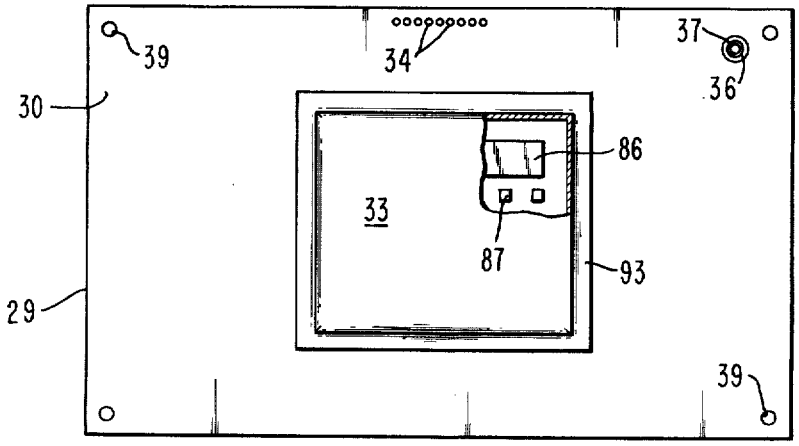
FIG. 3C is a rear view of the display panel assembly shown in FIG. 3A.

The spatial arrangement of major components of the panel Assembly 18 are contiguous and form a unified structure. To this end, and referring first to FIG. 3A, the front cover plate 24 is a transparent window that may be formed of, for example, glass. The front cover plate has a marginal seal 26 along the window margins whereby it is sealed to a rectangular spacer 27 (FIG. 3B). As may be recognized, the spacer may be a separate part or may be integral with either the front cover plate 24, or a rear multilayer, gas impervious cover plate 29, described hereinafter. The spacer 27, in conjunction with the front cover plate 24 and the rear cover plate 29 forms a gas chamber 28 with a thin or shallow dimension in the plane perpendicular to the plane of the plates. As will be described in more detail hereinafter, electrodes are mounted in confronting, spaced apart relation in the gas chamber 28 a first set being mounted on the rear surface of the front cover plate window 24 and a second set being mounted on the front surface of the multilayer rear cover plate 29. Mounted on and connected to the rear external face 30 (FIG. 3C) of the multilayer rear cover plate 29 are a plurality of active and passive devices such as integrated circuit devices 31 including transistors, etc. and may include other passive devices such as resistors, capacitors, coils etc. that control the alpha-numeric characters of the gas discharge display lines 22 as shown in FIG. 2. The integrated circuits or transistors 31 and other active and passive devices may be supported on and electrically connected to the rear of the rear cover plate 29 in any well known manner to interior circuit line conductors that are enclosed within the layers of the multilayer rear cover plate 29. Preferably cover means, in the illustrated instance a cover 33, hermetically encloses the integrated circuits, and other active and passive devices on the rear surface 30 of the multilayer cover plate 29.

In order to make external electrical signal and power connections to the active and passive devices mounted on the rear surface 30 of the multilayer rear cover plate 29, pins 34 are connected to the rear surface 30, the pins being connected in turn to interior circuit line conductors that are enclosed within and between the layers of the multilayer plate. A tubular seal off connection 36 is bonded to the rear surface 30 of the multilayer rear cover plate 29 and is in communication with a passageway 37 through the cover plate 29 which is in turn in fluid communication with the gas chamber 28. In a conventional manner, the seal-off connection 36 is used to evacuate the gas chamber 28 and then to recharge the same with low pressure ionizable gas, thereafter the seal-off connection is sealed by heat fusion of the tubing.

Figure 4A:
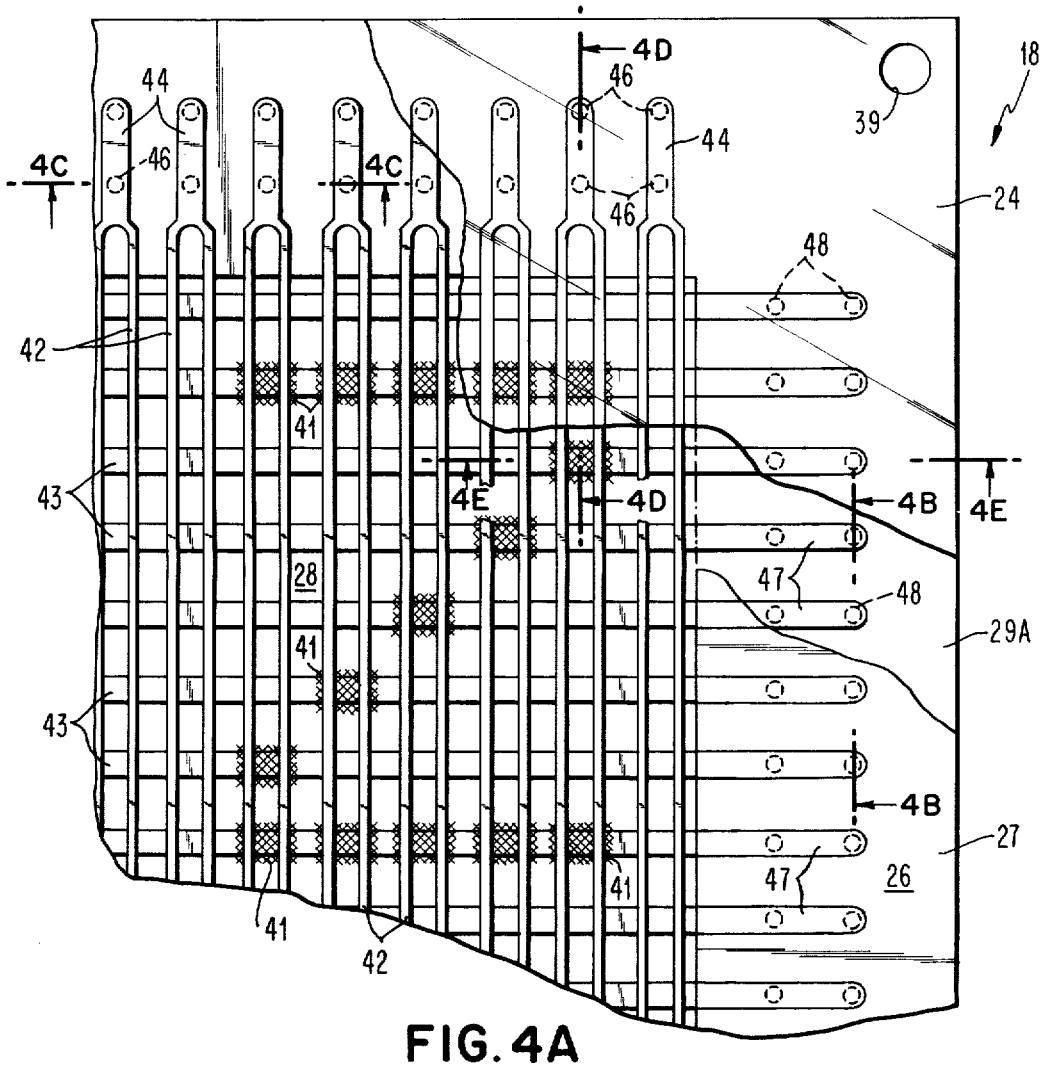
FIG. 4A is an enlarged fragmentary view of a portion of the panel illustrated in FIG. 3A.
Figure 4B:
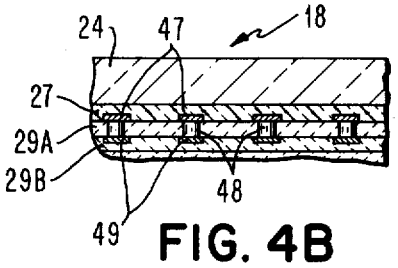
FIG. 4B is a fragmentary sectional view taken along line 4B—4B of FIG. 4A.

The gas discharge display Assembly 18 creates a display of alpha-numeric information upon the energization with suitable voltage of transversely extending spaced apart electrodes in the gas chamber, the ionization being localized and pinpointed at the intersection of the two electrodes upon energization thereof. To this end, and referring first to FIG. 4A, a gas discharge display of the letter *z* is illustrated therein. The gas discharge has the appearance of small glowing areas 41 in the gas chamber 28 at, as has previously and heretofore been described, electrically selected intersections of selected vertical and horizontal electrodes 42 and 43 respectively. (It should be recognized that vertical and horizontal are terms employed only for ease of viewing and recognition by the reader).

In order to effect such localized ionization, the electrodes are arranged to intersect in transversely confronting relationship with one another but in spaced apart relation. To this end the multiple vertical electrode 42 are bonded to and supported by the inside surface of the transparent cover plate 24. In a like manner, multiple horizontal electrodes 43 are bonded to and supported by the front surface of the multilayer rear cover plate 29. Each of the electrodes 42 and 43 are covered by a thin layer of dielectric material, in the present instance the dielectric on the vertical conductors being transparent, and provided with an additional coating of protective material, the protective coating, which will be more fully described hereinafter with relation to FIGS. 17 and 18, being utilized, at least in part, to inhibit dissipation by ionic sputtering.

At least between the vertical and horizontal electrodes 42 and 43 is the gas discharge chamber 28, in the present instance the electrodes being within the chamber. The chamber 28 contains a low pressure ionizable gas, for example, a mixture of neon and a small amount of argon. In the example, the gas mixture can be excited and ionized to provide a neon red glow discharge when an electrical potential that is sufficiently high to ionize the gas is applied between selected vertical and horizontal electrodes. Thus by suitably programming the ionizing voltage potentials to selected vertical and horizontal electrodes, small glow discharge areas 41 can be initiated and maintained in the gas chamber at horizontal and vertical electrode intersections.

Figure 4D:
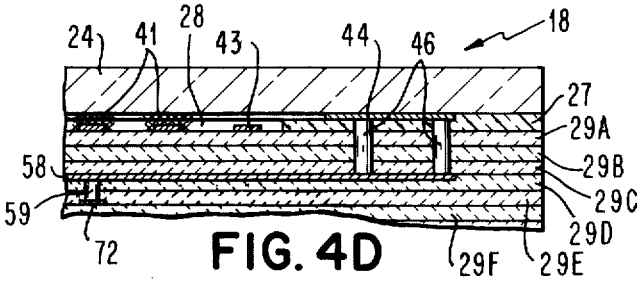
FIG. 4D is a fragmentary sectional view taken along line 4D—4D of FIG. 4A.
Figure 4C:
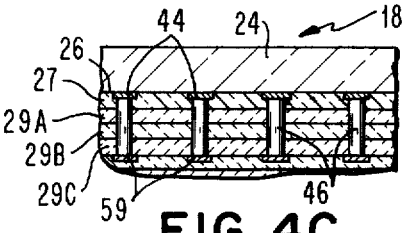
FIG. 4C is a fragmentary sectional view taken along line 4C—4C of FIG. 4A.
Figure 4E:
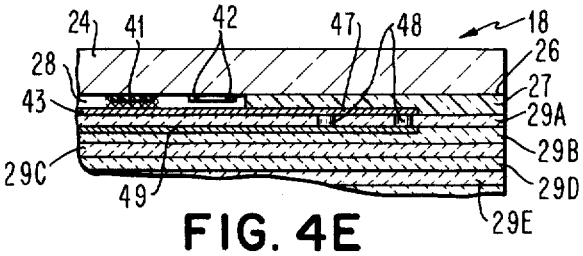
FIG. 4E is a fragmentary sectional view taken along line 4E—4E of FIG. 4A.

In order to provide good visibility of the luminous areas 41, the vertical electrodes 42 are arranged to function electrically as spaced apart electrode pairs by being end-connected to common electrical terminals 44. In this arrangement both electrodes of each pair operate at the same potential and due to their physical spacing, a major portion of the luminous areas 41 is visible through the space between the electrode pairs without being obscured by the electrodes. Additionally, by joining the electrodes of each electrode pair at their top and bottom ends with the common terminals 44, a redundant electrical connection is provided in the event that one of the electrodes of the pair of electrodes is or becomes open circuited. The metallization of the terminals 44, where the vertical electrode 42 are joined together is wider than the individual vertical electrodes of the pair and provides electrical terminals over the marginal seal and the spacer areas for connection to metallization in via holes 46 of the marginal seal 26 and the spacer 27, as may be seen in FIGS. 4C, and 4D.

It should be recognized that the electrodes 42 may be formed in any convenient manner, no particular process being essential to the operation of the panel. One method of forming the metallized patterns of the vertical electrodes 42 and the terminals 44 on the inside surface of the transparent cover plate 24, where the cover plate 24 is made of glass is that a first thin layer of chromium is vacuum deposited over the entire inside surface of the cover plate. Chromium is used because it forms a good bond to glass and an acceptable substrate for a thicker layer of copper that is then vacuum deposited over the chromium. Thereafter, a thin cover layer of chromium is vacuum deposited over the copper. The chromium-copper-chromium metallization is then coated with a thin film of photo sensitive, etch resistant material such as KTFR. The KTFR film is photo exposed and developed to leave an etch resistant pattern on the metallization corresponding to the vertical electrodes 42 and the terminals 44. Thereafter, selective etching solutions may be used sequentially to etch remove portions of the cover layer of chromium, the copper layer, and the bonding layer of chromium but leaving the metallized pattern of vertical electrodes 42 and the terminals 44 that were protected by the exposed KTFR film. The residual film of KTFR may then be removed and the panel 24, with the vertical electrodes 42 and the terminals 44 may then be cleaned.

The foregoing process leaves vertical electrodes 42 and terminals 44 of chromium-copper-chromium. The electrodes are then covered with a dielectric material such as a glass. To this end, a slurry of finely ground glass particles in a liquid vehicle is sprayed to form a layer of glass slurry over the entire interior or rear surface of the front cover plate including the vertical electrodes and terminals. The plate is then heated in an oven to approximately 600°C and the particles of the glass slurry coalesce to form a thin dielectric glass coating over the vertical electrodes, the terminals and the rear of the front cover plate. After cooling, a suitable photo resist material is applied over the glass coating, exposed, and developed to provide an etch resistant layer over the glass except for a pattern of apertures over the terminals 44. An etch solution then removes the dielectric glass from the pattern of apertures to expose at least portions of the chromium copper chromium terminals. The top layer of chromium is then etched to expose the copper terminals. After cleaning, a thin film of transparent magnesium oxide is vacuum deposited over the dielectric glass in an area corresponding to the area of the gas chamber using a mask to protect the marginal areas and the copper terminals 44 from being coated by the magnesium oxide. After cooling the front cover plate, the vertical electrodes and the copper terminals are cleaned prior to subsequent assembly operations.

As heretofore described the horizontal electodes 43 are electrically conductive and are mounted on the front surface of the multilayer rear cover plate 29. The spatial arrangement of the horizontal electrodes 43 relative to other elements of the panel assembly 18 is best shown in FIGS. 4A–4E. Several processes may be employed for forming the horizontal electrodes including the process previously described relative to the formation of the vertical electrodes 42 and terminals 44. Another process for forming the horizontal electrodes by screening molybdenum paste is described subsequently in conjunction with a process for forming the rear cover plate 29 as a multilayer ceramic. After forming the horizontal electrodes 43 to a suitable pattern, the portions of the front cover plate and the horizontal electrodes that are within the gas chamber 28 are coated with a thin layer of dielectric glass and then overcoated with a vacuum deposited film of magnesium oxide.

The multilayer rear cover plate is preferably formed of gas impervious insulating material, in the present instance including multiple layers composed of suitable materials such as ceramic, glass, quartz etc. which are bonded together to form an integral structure. The horizontal electrodes 43 are preferably in a latice pattern supported by and extending across the multilayer rear cover plate and terminating in terminal ends 47 in the right and/or left marginal area of the cover plate. In the illustrated instance, the marginal area bounds the gas chamber 28 and is in the right and left hand edge of the panel assembly. By locating the terminal ends 47 in the marginal areas space is available for redundant electrical interconnections of individual terminals 47 to associated pairs of metallized via hole conductors 48 also located in the marginal area. Interconnected for redundancy to each of the metallized via hole conductors 48 are individual horizontal circuit line conductors 49 located interior of the multilayer rear cover plate 29, in the illustrated instance equal in length to the horizontal electodes 43. The redundancy provides improved interconnection reliability by a factor of approximately four when right and left marginal areas are employed, or by a factor of two when only a right or a left marginal area is employed.

In the preferred embodiment of the invention a ceramic is used to form the multilayer rear cover plate 29. To this end, various compositions of material may be employed for the ceramic. In this connection, a brief manufacturing process outline for one ceramic composition is included herein but the scope of the invention is not intended to be limited to this single manufacturing process and/or composition. The ceramic composition is initially a slurry having about 94 percent alumina and 6 percent glass as finely ground particulate matter mixed with a polymerizable organic liquid and a small amount of volatile organic liquid to form a mobile casting slurry. The slurry is poured on a slowly moving conveyer belt which draws slurry under a doctor blade to regulate the casting thickness to, for example, about 0.013 inches. The moving belt then carries the slurry through an oven where the particulate matter separates from a portion of the liquids to settle onto the belt, most of the volatile liquid then being evaporated. The cast material is stored on the belt for several days in circulating air to further evaporate volatile liquid in the cast material, the cast material now having a thickness of about 0.008 inches. At that time the cast material has sufficient strength that the conveyer may be separated therefrom. The web is white and has the texture and thickness of weak and brittle paper. In this form the web is known to manufacturers as "green sheet" inasmuch as the ceramic material has not been fired or sintered in a furnace or kiln. Thereafter the web of green sheet material is inspected for imperfections such as overly thick or thin areas, dirt inclusions and pinholes. Accepted areas of the web of green sheet material are then cut into squares or rectangles with accurately located X-Y registration and stacking holes pierced near the corners thereof. In the event that the material is cut into squares, which is preferable, the edge dimensions of the squares may be approximately 1.2 times the length of the rear cover plate 29 to allow for approximately 17 percent shrinkage of the green sheet material during firing and sintering and to provide a small allowance for trimming to achieve required manufacturing dimensions.

To provide for electrical interconnections between the layers of the multilayer rear cover plate 29, as well as front and rear surface connections, via holes are pierced at suitable locations in each layer for subsequent filling with electrically conductive material. Dimensional X-Y registration of the via holes may be accomplished by various means such as positioning registration holes in the green sheets over four accurately located registration pins with the via holes then being accurately pierced relative to the registration pins.

The filling of the via holes with electrically conductive material may be accomplished by various manufacturing techniques well known in the art. For example, a screening mask may be positioned over the green sheet, the mask being aligned with the four X-Y registration holes discussed above. The mask, as is typical, has open apertures corresponding in dimension and position to the previously pierced via-holes. A paste of electrically conductive particles such as molybdenum in a volatile liquid is squeegeed through the apertures in the mask to fill the open via-holes in the green sheet. A layer of porous material, such as tissue paper, may be used under the green sheet material during screening to avoid entrapment of air and insure the filling of the via-holes. The mask and the porous material are then stripped off the green sheet leaving the via-holes filled with a paste of conductive material leaving the remaining surface of the green sheet in pristine condition.

Figure 11A:
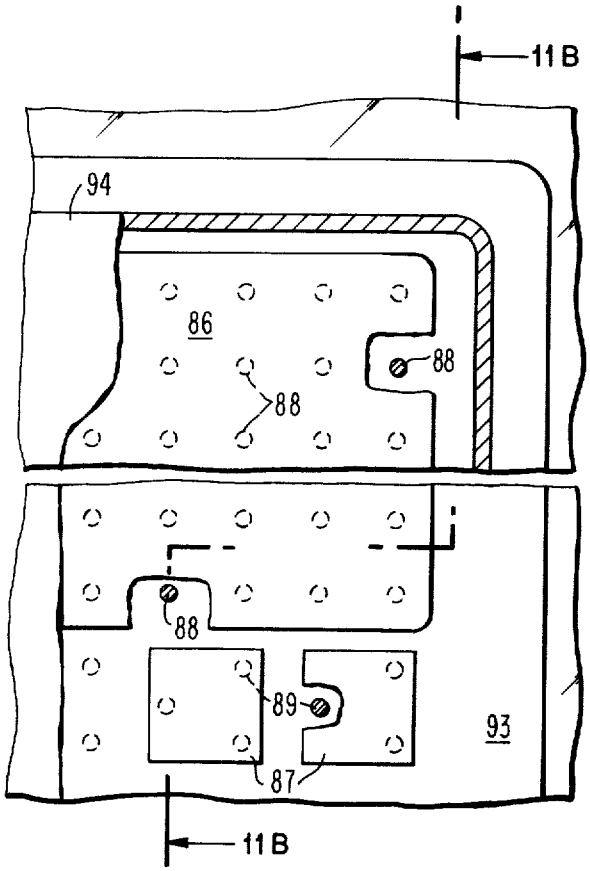
FIG. 11A is an enlarged fragmentary sectional view of a portion of the rear cover plate as viewed from the rear.
Figure 11B:
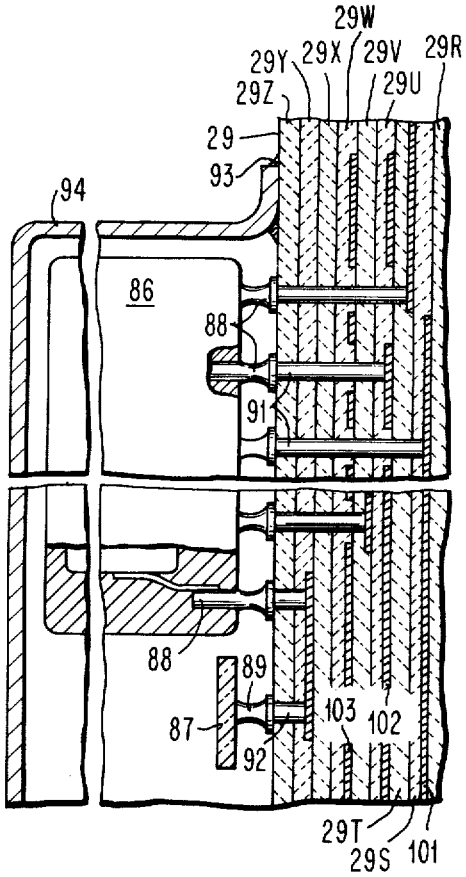
FIG. 11B is a fragmentary sectional view taken along lines 11B—11B of FIG. 11A.
Figure 12A:
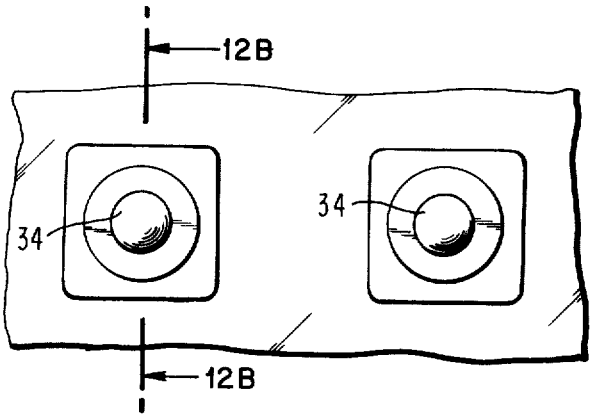
FIG. 12A is an enlarged fragmentary view of certain of the power supply and signal connections shown in FIG. 3C.
Figure 12B:
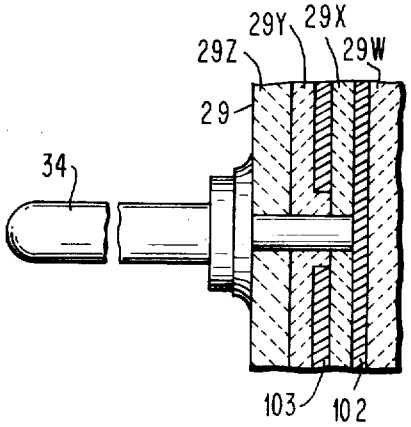
FIG. 12B is a fragmentary sectional view taken along lines 12B—12B of FIG. 12A.
Figure 13A:
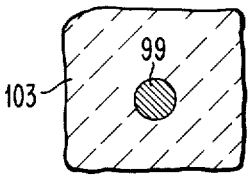
Figure 13B:
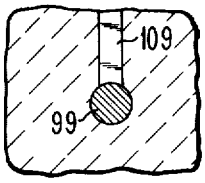
Figure 13C:
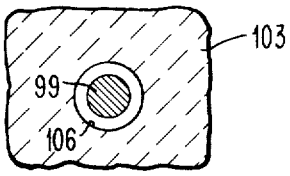
Figure 13D:
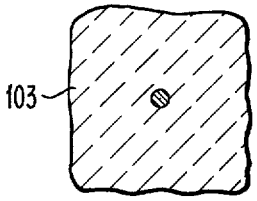
Figure 13E:
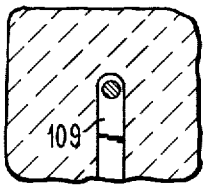
Figure 13F:
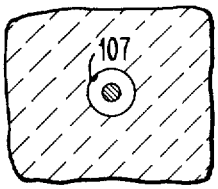

For purposes of identification, the various layers of the multilayer rear cover plate 29 are sequentially designated as 29A, 29B, 29C etc. starting with the front surface of the rear cover plate. (See FIGS. 4B–4E) A marginal spacer 29 (designated 29S in this embodiment), which may be optionally used in one mode of construction, is not part of the sequence but when it is used it is located in front of the front layer 29A. The total number of layers is variable depending upon the type and complexity of the electrical circuits desired interiorly of the multilayer rear cover plate 29. As noted in FIGS. 11B and 12B, the last six layers are designated as 29U, 29V, 29W, 29X, 29Y, and 29Z with a layer 29Z being the rear layer of the multilayer rear cover plate regardless of the total number of layers.

Figure 6A:
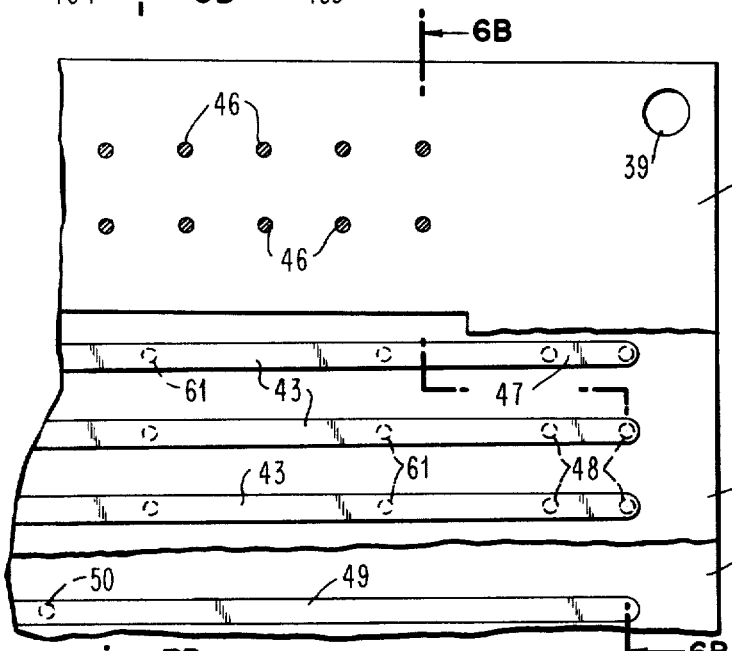
FIG. 6A is an enlarged fragmentary sectional view of the front surface of one of the layers of the multilayer rear cover plate, constructed in accordance with the present invention.
Figure 6B:
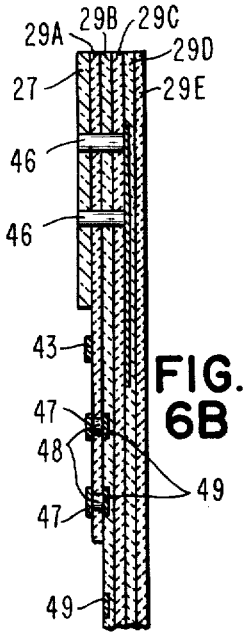
FIG. 6B is a fragmentary sectional view taken along lines 6B—6B of FIG. 6A.

After filling of the via holes, conductive circuit patterns may be disposed at any angle on the surface of the sheets for later mating to form a multilayer rear panel. With regard first, to the horizontal electrodes 43 and their terminals 47, these electrodes and terminals shown in FIGS. 4A and 6A, may be formed on the front surface of the rear cover plate or the top ceramic green sheet layer 29A designated as the front surface of the rear cover plate 29, by various suitable means without intending to be limiting as to the scope of the invention. One such suitable means for forming the electrodes and their terminals on the front surface of the rear cover plate 29 is to first laminate the layers and sinter the same and then form the horizontal electrodes. The process, in this instance which may be employed to form the electrodes is similar to that previously described relative to the vertical electrodes on the front cover plate wherein a chromium-copper-chromium metallization of the electrodes may be accomplished.

A preferred means for forming the horizontal electrodes 43 and terminals 47 is the positioning of a second screening mask over the green sheets with the mask being aligned by four X-Y registration holes on the same and/or equivalent four registration pins previously used to register the first screening mask with the green sheet. The second screening mask may have aperatures corresponding in dimension and position of the horizontal electrodes 43 and their terminals 47. Molybdenum paste is then squeegeed through the open apertures of the mask on to the green sheet. The mask is next stripped off the green sheet leaving a pattern of electrically conductive paste particles on the green sheet corresponding to the required horizontal electrodes and terminals. In this instance the described registration means enables the screened paste particles of the horizontal electrodes 43 and the terminals 47 to accurately overlap and interconnect with the paste particles in the previously filled via-holes 48.

It should be recognized that the above described means for piercing and filling via holes and forming electrodes and terminals on the front surface layer of the multilayer rear cover plate 29 may be used for making similar filled via-holes and circuit line conductors on various layers for the rear cover plate.

Typical examples of the versatility for forming electrodes, electrical circuit line conductors, voltage and via-hole conductors on individual green sheet layers is illustrated in FIGS. 4A to 15. After formation, the green sheets are stacked, laminated and sintered to form an integral multilayer ceramic such as the rear cover plate 29 having external electrodes interconnected with internal electrical wiring or conductors. In conjunction with using electrical and electronic components supported by and connected to the rear surface of the multi-layer rear cover plate 29, various types of control and drive circuits for the active display area 29 may be constructed. The circuits described in U.S. Pat. No. 3,597,758, assigned to the assignee of the present invention, are typical of such circuits that may be employed using the features of the multilayer rear cover plate 29.

The electrical interconnection redundancy is a feature provided by the green sheet multilayer construction of display panels intended for heavy duty usage conditions. This feature maintains or increases the useful life of the display panel in the event that a minute crack might occasionally occur in the electrodes or in the dielectric glass and magnesium oxide overcoating on the electrodes during fabrication. When such a crack occurs through the overcoatings on an electrode the metal of the electrode is exposed to ionic bombardment through the crack during the operation of the display panel. The ionic bombardment may gradually remove the metal of the electrode under the crack a process known as ionic gas sputtering. Total removal of the metal may eventually cause an electrical open circuit in the electrode. Of, course a crack may occasionally appear in an electrode during fabrication which also causes an open circuit in the electrode. With only one terminal supplying voltage to the electrode up to the open circuit the portion of the electrode beyond the open circuit then no longer receives voltage and the panel becomes at least partially inoperable for display purposes. However, by providing electrical interconnection redundancy to the electrodes as previously described, the electrodes are provided with voltage from terminals at both ends of the electrodes. Then if an open circuit occurs in an electrode between the terminals, voltage continues to be supplied by the terminals to the portions of the electrode on either side of the open circuit and the panel continues to function for a longer period. Additional electrical interconnection redundancy may be provided for the horizontal electrodes 43 by one or more interconnecting via hole conductors 51 through layer 29A to the horizontal circuit line conductors 49. (FIG. 6A) The via-hole conductors 61 can thus provide means for maintaining proper operation of the display panel by supplying voltage to portions of the horizontal electrode in the event that two open circuits might occur in the same electrode.

In display panels intended for light duty or when lower manufacturing cost is an important consideration, the total number of layers in the multilayer rear cover plate 29 may be reduced by one or two layers by omitting the electrical interconnection redundancy construction supplying redundant voltages to the electrodes 42 and 43 and using a non-redundant construction. Thus, depending on the design objectives of the circuit designer, either a redundant or non-redundant construction may be employed for the display panel; however, it is to be understood that the redundant construction is the preferred construction for the display panel.

Figure 8A:
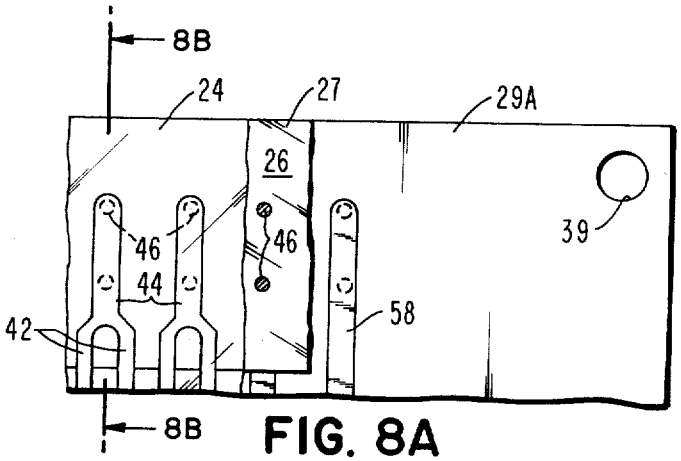
FIG. 8A is a fragmentary plan view illustrating a portion of a spacer layer.
Figure 8B:
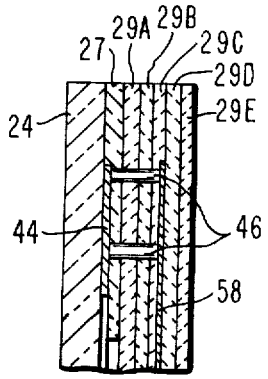
FIG. 8B is a fragmentary sectional view taken along line 8B—8B of FIG. 8A.
Figure 9A:
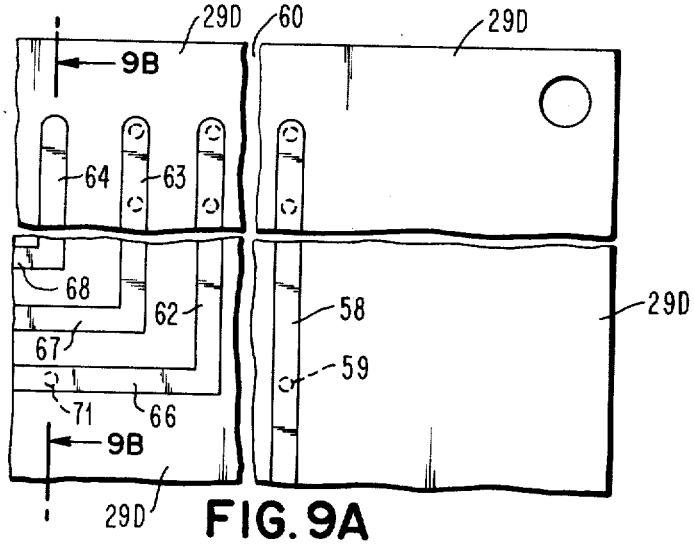
FIG. 9A is an enlarged fragmentary sectional view illustrating a portion of another layer of the multilayer rear cover plate, with portions of the structure removed to better illustrate the underlying structure.
Figure 9B:
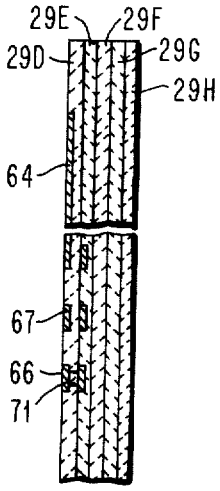
FIG. 9B is a fragmentary sectional view taken along lines 9B—9B of FIG. 9A.
Figure 10A:
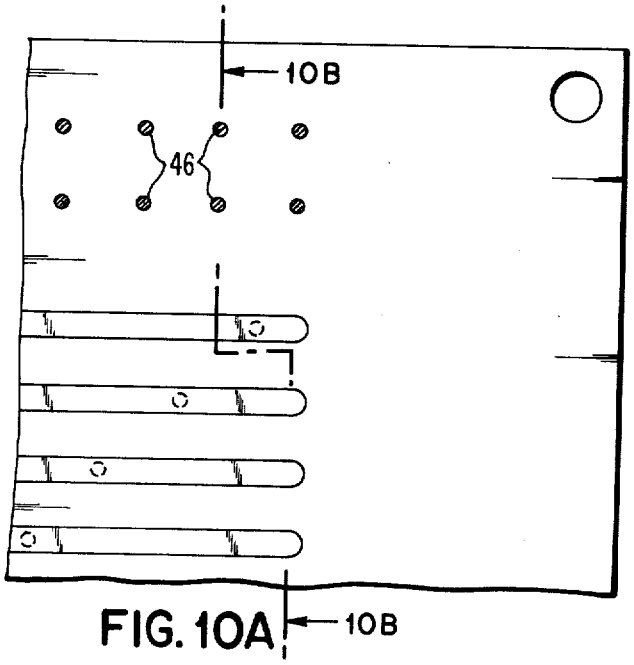
FIG. 10A is a fragmentary sectional view of a portion of the alternate embodiment of the invention illustrated in FIG. 5A with certain portions of that embodiment removed for clarification of the structure of one of the layers of the multilayer rear cover plate.
Figure 10B:
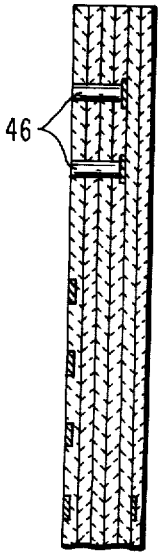
FIG. 10B is a fragmentary sectional view taken along lines 10B—10B of FIG. 10A.

For example, conductor patterns providing either circuit line redundancy or non-redundant constructions for supplying voltages to the lattice of vertical electrodes 42 are shown in a side-by-side comparison separated by a sectional break 60 in FIG. 9A. In the redundant construction the layer 29D to the right of the sectional break 60 is shown with one vertical conductor 58 of a lattice of vertical circuit line conductors 58. The individual conductors 58 are preferably aligned beneath the lattice of individual vertical electrodes 42 and extend from near the top edge to near the bottom edge (not shown) of the layer 29D. The multiple circuit line conductors 58 of the lattice are connected to and supply redundant voltages to the top terminal ends 44 and the bottom terminal ends (not shown) of the lattice of vertical electrodes 42 by interconnections with the via-hole conductors 46. (See FIG. 8A) The complete lattice of vertical circuit line conductors 58 is not shown but it is to be understood that the lattice of vertical conductors 58 extends to the left across the sectional break 60 and occupies most of the surface area of the layer 29D. Typical via-hole conductors such as 59 supply voltage to the individual vertical circuit line conductors 58 of the lattice from circuit elements such as 72 on other layers such as 29E as shown in FIG. 9B.

In the non-redundant construction referred to above, the layer 29D to the left of the sectional break 60 is shown with typical shorter vertical circuit line conductors 62, 63, and 64 that supply non-redundant voltages to only the top terminal ends 44 of the vertical electrodes 42 by interconnections with the via hole conductors 46 (See FIG. 8A). Since the shorter vertical circuit line conductors are not arranged in a lattice that occupies most of the surface area of the layer 29D some of the area is available on the layer 29D for typical horizontal circuit line conductors such as 66, 67, and 68 that interconnect the vertical conductors 62, 63, and 64 to other circuit elements (not shown) or via hole conductors such as 71 on and/or through the same one layer 29D. Thus with non-redundancy, the circuit layout designer can reduce manufacturing costs by placing the vertical and horizontal circuit line conductors on the same layer 29D, as compared to using two separate layers to obtain redundancy: one separate layer 29D for a lattice of vertical circuit line conductors 58 providing redundancy and interconnected by via hole conductors such as 59 to horizontal circuit line conductors such as 72 on a second separate layer such as 29E (FIG. 9B).

Figure 7A:
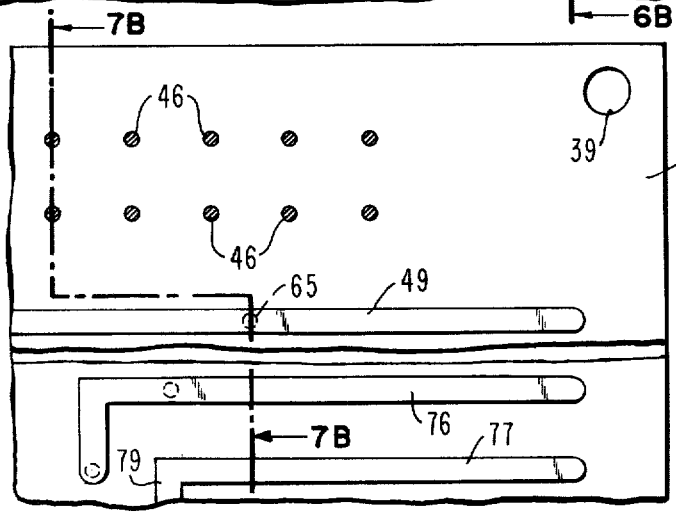
FIG. 7A is a view similar to FIG. 6A but showing another layer, in fragmentary sectional form, of the multilayer rear cover plate.
Figure 7B:
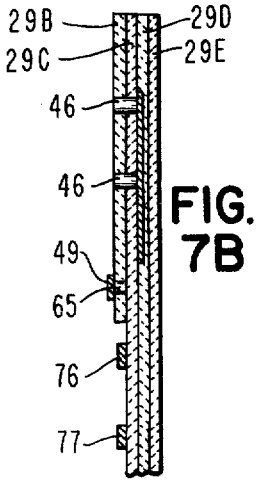
FIG. 7B is a fragmentary sectional view taken along lines 7B—7B of FIG. 7A.

As a further example, conductor patterns providing either circuit line redundancy or non-redundant constructions for supplying voltages to the lattice of horizontal electrodes 43 are shown in a one-above-the-other comparison separated by a sectional break 45 in FIG. 7A. In that redundant construction the layer 29B above the sectional break 45 is shown with one horizontal conductor 49 of a lattice of multiple horizontal circuit line conductors 49. The individual conductors 49 of the lattice (FIG. 7A) are preferably aligned beneath the lattice of individual horizontal electrodes 43 and extend from near the right edge to near the left edge (not shown) of the layer 29B. The multiple circuit line conductors 49 of the lattice are connected to and supply redundant voltages to the right terminal ends 47 and the left terminal ends (not shown) of the horizontal electrodes 43 by interconnections with the via hole conductors 48. The complete lattice of horizontal circuit line conductors 48 is not shown but it is to be understood that the lattice of horizontal conductors 49 extends downward across the section break 45 and occupies most of the surface area of the layer 29B. Typical via hole conductors such as 65 supply voltage to the individual horizontal circuit line conductors 49 of the lattice from circuit elements such as 73 on other layers such as 29C as shown in FIG. 7B.

In the non-redundant construction, for comparison, the green sheet layer 29B below the sectional break 45 is shown with typical shorter horizontal circuit line conductors such as 76 and 77 that supply non-redundant voltage to only the right terminal ends 47 of the horizontal electrodes 43 by interconnections with the via hole conductors 48. Since the shorter horizontal circuit line conductors are not arranged in a lattice that occupies most of the surface area of the layer 29B some of the area is available on the layer 29B for vertical circuit line conductors such as 78 and 79 that connect with other circuit elements (not shown) or via hole conductors such as 81 on or through the same layer 29B. Thus with non-redundancy the circuit layout designer can reduce manufacturing costs by placing both horizontal circuit line conductors 76 and 77 and vertical circuit line conductors 78 and 79 on the same layer 29B as compared to using two separate layers with redundancy; one separate layer 29B with a lattice of horizontal circuit line conductors 49 providing circuit redundancy and interconnected by via hole conductors such as 65 to vertical circuit line conductors such as 82 on a second separate layer such as 29B.

Various suitable means may be employed for supporting and providing electrical interconnections for the electrical packages and the electronic substrates on the rear surface of the rear cover plate 29. To this end, and referring to FIGS. 3C, 11A and 11B, in a preferred means the electrical packages 86 and the electronic substrates 87 are fabricated with solder pads 88 and 89 respectively on their front surfaces that function as terminals interconnected with electrical and/or electronic devices within the packages 86 or on the substrates 87. Via hole conductors such 91 and 92 through the green sheet layer 29Z of the multi-layer cover plate 29 are formed in a suitable pattern for subsequent alignment in later assembly operations with the solder pads 88 and 89 respectively. After a solder reflow operation the solder pads 88 and 89 in conjunction with the via hole conductors 91 and 92 provide mechanical support and electrical interconnections for the electrical packages 86 and the electronic substrates 87. A more detailed description of the above assembly operations is set forth hereinafter.

In preparation for providing a hermetically sealed enclosure for the electrical packages 86 and the electronic substrates 87, a narrow band of metallization 93 is applied to the rear surface of the multilayer rear cover plate 29 outside the area occupied by the packages 86 and the substrates 87. Several processes may be used for applying the metallized band 93. In a preferred process, a paste made from molybdenum particles, a small percentage of glass particles, and a volatile liquid is applied through a screening mask to form the required pattern. After the layer 29Z together with the other layers of the multilayer rear cover plate 29 have been stacked and laminated the stacked assembly is sintered. During sintering the molybdenum particles coalesce, with the glass particles providing a strong bond to the ceramic material of the rear cover plate. Later processes prepare the molybdenum metallization 93 for soldering to a hermetic enclosure 94.

In an alternate process for forming the metallized band 93, the green sheet layer 29Z together with the other green sheet layers for the multilayer rear cover plate 29 are first stacked, laminated, and sintered. At this step in the overall process sequence for the display panel it may optionally be convenient, but not necessary, to assemble the rear cover plate 29 to the front cover plate 24. After the sintering of the rear cover plate 29, or its assembly to the front cover plate 24, a suitable paste, for example made from a material which has a lower or equal coalescing temperature with the glass to ceramic bonding material or the glass itself is employed to form the band 93. For example a paste made from Incusil (a conductive alloy of indium, copper, and silicon) particles and a volatile liquid may be applied through a screening mask to form the metallized band pattern 93 on the rear surface of the multilayer rear cover plate 29.

Referring again to the preferred process, as a further step in preparing the molybdenum metallization for soldering to a hermetic enclosure, the Incusil paste may also be applied in a pattern over the sintered molybdenum of the metallized band 93, and if desired over the individual small exposed areas of the sintered molybdenum of the via hole conductors 91 and 92 on the rear surface of the rear cover plate 29. With either the preferred or the alternate processes heating in an oven causes the Incusil particles to coalesce and bond to the sintered ceramic and/or molybdenum on the rear of the rear cover plate 29. Later processes further prepare the Incusil surfaces for solder assembly with the electrical packages 86, the electronic substrates 87, and the hermetic enclosure 94.

The multilayer rear cover plate 29 features a unique means for both supporting and providing electrical interconnections for many of the contiguous electrical and electronic components that control and supply voltages to the electrodes 42 and 43 of the display panel whereby such interconnections are hermetically sealed within the rear cover plate 29 or within the contiguous structure of the display panel.

The number and locations of electrical and electronic components on the rear of the rear surface of the multilayer rear cover plate 29 is determined by the type of circuit selected for the display panel and the circuit layout designer's interpretation and optimumization of detail circuit design requirements. While a full description of such detail circuit design is beyond the scope of the present description it should be understood that the design flexibility provided by the forming of circuit elements on and/or through individual green sheet layers can be accommodated to substantially all circuits and circuit designs that might be selected. Examples of such design flexibility are shown in FIGS. 11A, 11B and 13D–13F.

Individual electrical components and/or multiple electrical components in one package 86 can include such passive electrical components as resistors, capacitors, inductors, transformers, etc. and/or combinations thereof. Individual electronic components and/or multiple electronic components on one substrate 87 can include active electronic components such as transistors, diodes, integrated circuits, etc. and/or combinations thereof. While only one electrical package 86 and only two electronic substrates 87 are shown it is to be understood that multiple electrical packages 86 and multiple electronic substrates 87 can be located on the rear surface of the multilayer rear cover plate 29. It is to be further understood that because of differing manufacturing processes and physical size it is generally preferable to dedicate the larger packages 86 to electrical components and the smaller substrates 87 to electronic components; however, it is frequently convenient for the circuit layout designer to also locate electronic components in the electrical packages 86 and electrical components on the electronic substrates 87.

In preparation for the assembly of the external pin connectors 34 (FIGS. 12A and 12B) small metallized areas 97 are applied to the rear surface of the multilayer rear cover plate 29 over the locations of the via hole conductors 98 using processes similar to those previously described for forming the metallized band 93 and applying metallization to the via hole conductors. The via hole conductors 98, associated with the pins 34, interconnect with other circuit elements on other layers of the multilayer rear cover plate 29. The metallized areas 97 may be formed from molybdenum, Incusil, or Incusil over molybdenum and are made larger than the via hole conductors 98 to provide larger support bases for the external pin connectors 34. The external pin connectors 34 are assembled to the metallized areas 97, preferably by brazing, in later assembly operations.

Several green sheet layers that may be used to form the structure between the front and rear layers of the multilayer rear cover plate 29 are hereinafter referred to as intermediate green sheet layers such as layers 29B to 29Y. The function of each layer of such intermediate green sheet layers is to provide a suitable supporting media for the application of metallization patterns on and/or through the layer. The circuit layout designer determines the metallization patterns for each intermediate layer such that when sequential intermediate green sheet layers 29B to 29Y are stacked one above another together with the front green sheet layer 29A and the back green sheet layer 29Z, continuous electrical circuits would be formed from front to back after the stacked green sheet layers have been laminated and sintered. In general, the designer tries to optimize the design to a minimum number of intermediate layers that would comply with the overall circuit requirements of the display panel. The green sheet metallization patterns may be different for each intermediate layer and the patterns of layers 29B (FIG. 7A) and layer 29D (FIG. 9A) may be considered to be typical examples of many such patterns having various combinations of short, long, horizontal, and vertical circuit line conductors which may be interconnected with each other and/or via hole conductors. However, other types of green sheet metallization patterns may preferably be used by the circuit layout designer when a large number of via hole conductors that are dispersed over a large area of a green sheet are required to interconnect with one common electrical conductor. For these other types of patterns intermediate green sheet layers such as 29S, 29U, and 29W, (FIGS. 11B, 12B, 13A and 13D) may have one or more large area planar metallization patterns such as squares, rectangles, circles, etc., and/or combinations thereof, that may be used as generally continuous and/or common electrical conductors such as 101, 102 and 103 for interconnection with a large number of dispersed via hole conductors. The large areas of the planar metallization patterns enable these common conductors to carry higher electrical currents than linear metallization patterns with linear branches when used as common conductors and interconnected with dispersed via hole conductors.

The higher electrical current capacities of such common conductors 101, 102, and 103 formed from planar metallization patterns may be particularly useful for electrical distribution conductor planes such as for power, voltages, electrical grounds, signals, and similar electrical distribution functions. In such higher electrical current applications a larger via hole conductor 98 (FIGS. 12B and 13A) may be used as an interconnection between an external terminal pin 34 and a planar distribution common conductor 102 while with a lower electrical current a smaller via hole conductor (FIGS. 12A and 13D) may be used as an interconnection between an electrical package and the planar distribution common conductor 102. When required by the circuit design layout the larger via hole conductor 98 (FIGS. 12B and 13C) and/or the smaller via hole conductor (FIGS. 12A and 13F) may be arranged to pass through a planar common conductor 103 without making an electrical contact by providing small doughnut shaped non-metallized green sheet areas such as 106 and 107 around the via hole and conductors 98. While it is preferable to associate all of the external terminal pins 34 (FIG. 3B) with large via hole conductors such as 98 and 99 (FIGS. 12B, 13A–13C) passing through two or more green sheet layers 29Z, 29Y, etc. to assist in the mechanical support for the pins, one or more of the pins and larger via hole conductors may be used only for very small electrical signal currents and thus may be interconnected by only a circuit line conductor 109 (FIGS. 13B and 13E) on an intermediate green sheet layer to a via hole conductor. The large area metallized conductors may be preferably located in the stacking sequence near the rear green sheet layer 29Z but they may also preferably be interleaved between layers having lesser areas of metallization such as the typical layers shown in FIGS. 7A and 7B in order to avoid concentrating the density of metallization.

The primary functions of the gas chamber spacer are to provide marginal spacer means interposed and sealed between the front coverplate and the rear coverplate to form a sealed gas chamber space between the plates and to provide marginal electrical conductor means associated with the spacer means for interconnecting the electrodes of the front cover plate to the circuit elements of the rear cover plate. Several alternate processes may be used to form a marginal spacer means 27 illustrated in FIGS. 3A, 3B, 4A–4E, and the associated conductor means that are interposed and sealed between the front cover plate 24 and the rear cover plate 29. Such processes provide a hermetically sealed marginal spacer for the gas chamber 28 and electrical interconnection means within the contiguous structure of the gas panel Assembly 18.

In one such process the marginal spacer means 27 may be formed integrally with or as a sub-assembly with the front cover plate 24 and then subsequently assembled and sealed to the rear cover plate 29. When the marginal spacer means 27 is to be formed integrally with the front cover plate 24, a transitional slope may be used to accomodate the dimensional difference between the plane of the marginal spacer means and the plane on the inside of the front cover plate that is used for the vertical electrodes 42 and their interconnected terminal ends 44. Then after vacuum evaporation of metallization on the areas of the electrode plane, the transitional slope, and the marginal spacer plane, a photoresist and etch process may be used to form the vertical electrodes 42 and their interconnected terminal ends 44 by etch removal of surplus metallization.

When the marginal spacer means 27 is formed to be a sub-assembly with the front cover plate 24 the rear surface of the front cover plate is first vacuum metallized and a photoresist and etch process may be employed to form the electrodes 42 and their interconnected terminal ends 44 by etch removal of surplus metal. The marginal spacer means 27 may be formed to the required pattern configuration from a thick film of sheet glass by using a photoresist and etch process. The pattern configuration of the marginal spacer means may include suitable apertures to provide electrical connection access to the terminal ends 44 after the marginal spacer has been assembled and sealed to the inside of the front cover plate 24. Alternately, after the electrodes 42 and their terminal ends 44 have been formed on the rear surface of the front cover plate 24 the marginal spacer means 27 may be formed to the required pattern configuration by a screening process in which a slurry made from glass or other suitable particles and a volatile liquid is forced through a screening mask that contacts the rear surface of the front cover plate. The slurry adheres to the front cover plate forming the required pattern configuration after the screening mask is removed. The front cover plate and the slurry pattern configuration are then heated in an oven where the slurry coalesces and bonds to the front cover plate to form the marginal spacer means 27. The pattern configuration of the marginal spacer means 27 may be formed to include suitable apertures to provide electrical connection access to the terminal ends 44 on the front cover plate 24.

In a preferred process the marginal spacer means 27 may be formed integrally with or be a sub-assembly with the rear cover plate 29 and then subsequently assembled and sealed to the front cover plate 24.

When the marginal spacer means 27 is to be formed integrally with the rear cover plate 29 a transitional slope may be used to accomodate the dimensional difference between the plane of the marginal spacer means and the plane of the front surface of the rear cover plate that is used for the horizontal electrodes 43. The transitional slope between the plane of the marginal spacer means and the plane of the horizontal electrodes 43 may be formed by plastic deformation of the metallized stacked green sheet layers 29A–29Z by using a contoured upper platen in the heated laminating press. The contoured lower surface of the upper platen may include a marginal plane for forming the marginal spacer means, a transitional slope, and a plane for forming a flat area for the horizontal electrodes 43. The largest amount of plastic deformation may occur in layer 29A and become progressively less in sequential layers 29B–29Z. Accordingly, the front surface of layer 29A may have two levels after lamination with electrodes 43 extending across the plane of one level and up the transitional slope to the terminals 47 on a second level that forms the marginal spacer means 27. The metallized via hole conductors 46 preferably extend through the spacer 27.

When the marginal spacer means 27 is to be formed as a sub-assembly with the rear cover plate 29 the marginal spacer means may be a separate marginal green sheet layer 27 that is stacked, laminated, and sintered together with the green sheet layers 29A–29Z. As a separate green sheet layer 27 the layer may include the metallized via hole conductors 46, an aperture interior to the margin having dimensions generally corresponding to the size of the gas chamber 18, and four accurately located corner holes for stacking alignment. After the marginal green sheet layer 27 has been stacked on top of the green sheet layers 29A–29Z in the stacking fixture the fixture and the green sheet layers may be moved to a heated laminating press. The upper platen of the laminating press may have a stepped contour to accomodate the dimensional difference between the plane of the marginal green sheet layer 27 and the plane of the green sheet layer 29A used for the horizontal electrodes 43. The stepped portion of the upper platen may preferably be dimensioned to enter and fit the aperture interior to marginal green sheet layer 27. In the heated laminating press the green sheet layers 27 and 29A–29Z all bond together and after cooling may be removed as one sub-assembly.

A number of other processes may also be used to form the marginal spacer means 27 by combinations of the above described processes. For example, the marginal spacer means 27 may be formed by screening and coalescing the glass particles onto the front surface of the sintered rear cover plate 29; or alternately thinner layers of glass particles may be screened on both the front cover plate 24 and the sintered rear cover plate 29 and then coalesced when the thinner layers on the cover plates are assembled in contact with each other. As a further example, a thinner margin spacer means 27 may be formed integral with the front cover plate 24 and another thinner marginal spacer means 27 formed integral with the rear cover plate 29 with both thinner marginal spacer means subsequently being bonded and sealed to each other.

A number of suitable processes may be used for stacking and laminating the green sheet layers, with the use of a specific process being largely determined by the processes previously selected to provide the various configurations of the marginal spacer means 27.

In one such process the marginal spacer means 27 may cooperate with a flat front surface of the sintered multi-layer rear cover plate 29. To provide the flat front surface a required number of green sheet layers that have been previously metallized, inspected and accepted may be first stacked one above another on the flat surface of a stacking fixture. The stacking sequence preferably starts with the green sheet layer 29Z on the bottom and finishes with the green sheet layer 29A on the top of the stack. The alignment and registration between via hole metallization and circuit line metallization on an adjacent layers may be provided by four corner alignment holes 39 on each green sheet layer engaging four corresponding alignment pins of the stacking fixture. The stacking fixture and the stacked green sheets may then be placed between flat top and bottom platens in a laminating press where they may be subjected to simultaneous heat and pressure. The organic monomer that was originally mixed with the green sheet casting slurry and the molybdenum paste first becomes plastic during the heating process. In its plastic phase the organic monomer may allow a limited movement of the alumina and glass particles of the green sheet material and the molybdenum particles of the metallization whereby the particles may be compacted under the pressure of the laminating press. The laminating pressure may also cause the plasticized organic monomer and the particles on adjacent interfacing surfaces of the stacked green sheet layers to penetrate and superficially intermix across the interface surfaces to bond adjacent green sheet layers together. A continued application of heat and laminating pressure polymerizes and hardens the organic monomer whereby the stacked green sheet layers become a rigid structural unit. The stacking fixture and the stacked or laminated green sheet may then be removed from the laminating press, cooled, and the laminated green sheets removed from the fixture as a rigid structural unit with flat front and rear surfaces.

In another similar process the marginal spacer means 27 may be formed integral with the green sheet layers 29A–29Z by plastic deformation using a contoured upper platen in the laminating press as previously described relative to the Gas Chamber Spacer.

In another, but preferred, similar process the marginal spacer means may be a separate green sheet spacer layer 27 formed as a sub-assembly and concurrently laminated together with the green sheet layers 29A–29Z by using a stepped upper platen in the laminating press as also previously described relative to the Gas Chamber Spacer.

A sintering furnace or kiln may be used as a process means for converting the stacked and laminated green sheets into a multilayer ceramic. In the sintering process the stacked and laminated green sheets as a structural unit may be first loaded onto a flat alumina tile, preferably with the green sheet layer 29Z interfacing with the tile. The alumina and the laminated green sheets may be moved into the sintering furnace where they may be heated to about 1550°C in a hydrogen atmosphere for about 24 hours. While being heated in the furnace the alumina and glass particles of the laminated green sheets sinter and coalesce together into an integral ceramic to form the multilayer rear cover plate 29. Concurrently the heating causes the molybdenum metallization particles of the conductor patterns that were previously screened on and through the laminated green sheet layers to sinter and coalesce together to form continuous electrical conductors within the ceramic. The small percentage of glass particles previously mixed with the molybdenum screening paste bond the molybdenum conductors to the ceramic and contribute to the structural integrity of the multilayer rear cover plate 29. During the sintering process both the vertical and horizontal dimensions of the laminated green sheet layers may shrink about 17 percent. This shrink factor may further compact the coalescing molybdenum particles of the electrical conductor elements.

In a similar but preferred sintering process for the previously stacked and laminated sub-assembly in which the green sheet layer 27 was stacked and laminated together with the green sheet layer 29A–29Z the sintering process and coalescing causes the layer 17 to become a marginal spacer means that is an integral ceramic part of the multilayer rear cover plate 29. Concurrently the molybdenum metallization particles of the via hole conductors 46 and 48 sinter and coalesce to form continuous electrical conductors with other conductors within the ceramic.

The assembly of the front and rear cover plates of the gas discharge display panel may be accomplished by combinations of several suitable processes which may include initial preparation processes and subsequent assembly processes. The preparation processes may be essentially similar for various configurations of the marginal spacer means 27 while the use of a specific assembly process may be largely determined by the processes previously selected to provide a specific configuration for the marginal spacer means 27 and/or the electrical interconnected means between the front and rear cover plates.

In preparation for the assembly processes, the vertical electrodes 42 (FIGS. 4A, 14, 17) and an area (as defined by the dotted line 28A) of the rear surface of the front cover plate 24 slightly larger than the area of the gas chamber 28, may be given a thin coating of the dielectric glass particles by spraying on a slurry of dielectric glass particles mixed with a volatile liquid vehicle. After drying out the liquid vehicle a furnace may be used to melt and/or coalesce the dielectric glass particles to form a thin coating film of transparent dielectric glass 112 on the electrodes 42 and the front cover plate 24. Then a thin transparent film of magnesium oxide (MgO) 113 may be formed or deposited as an overcoat over the area of the dielectric glass by using a vacuum evaporation or sputtering process or other suitable processes. Preferably there should be no films of dielectric glass or magnesium oxide formed or deposited over the terminal ends 44 of the vertical electrodes 42. However, if such films may have been formed or deposited over the terminal ends 44 apertures for electrical connection access to the terminals 44 may be formed through the films by a photoresist and etch removal process.

Similarly in preparation for the assembly process, the horizontal electrodes 43 (FIGS. 4A, 9A, 15, 18) and an area of the front surface of the multilayer ceramic rear cover plate 29 slightly larger than the area of the gas chamber 18 may be given thin overcoating films of dielectric glass 112 and magnesium oxide 113 (FIG. 18) by using essentially the same processes described above for applying such thin films to the vertical electrodes 42 and the front cover plate 24.

As a further preparation for the assembly process the exposed areas of the via hole conductors 46 on the front surface of either the marginal spacer mean 27 or the multilayer rear cover plate 29 may preferably be given a coating of nickel or other suitable metal by electroless plating, vacuum evaporation, or vacuum sputtering to assist in metallurgical wetting of the via hole conductors 46 during subsequent assembly processes.

In a preferred assembly process for use when the marginal spacer means 27 may have been formed by previous processes to be a part of the multilayer ceramic rear cover plate 29 electrical interconnection means or discs 121 (FIGS. 15, 16A–16F) may be applied to the front surface of the marginal spacer means 27 in locations over the via hole conductors 46. The interconnection means 121 may be a suitable electrically conductive material applied in individual small areas that may be somewhat larger than the exposed areas of the via hole conductors 46. The conductive material of the interconnection means 121 may preferably be a slurry and/or paste made from metallic particles of a suitable brazing material, a flux, and a liquid vehicle. The brazing material may preferably be applied over the via hole conductors 46 which pass through the marginal spacer means 27 the brazing material being applied by a screening process using the slurry and/or paste and a suitable screening mask. Other processes for applying the material of the electrical interconnection means 121 to the marginal spacer means 27 may include electro-plating or vacuum evaporation or sputtering of the material using a suitable mask or using a photoresist and etch process. Still other processes for applying the conductive material to the marginal spacer 27 may include applying elements and/or mixtures and/or compounds of elements that may be inherently electrically conductive and/or may be caused to become conductive by suitable subsequent processes, and thus to perform the functions of the interconnection means 121.

As has been previously described, a principal function of the interconnection means or discs 121 is to provide electrical interconnections between the via hole conductors 46 and the terminal ends 44 of the vertical electrodes 42 during and/or after the assembly of front and rear cover plates in a heated oven. While prior manufacturing processes may have been directed to producing a flat rear surface for the front cover plate 24 and a flat front surface for the marginal spacer means 27 minor deviations from flatness may occasionally cause one or more thin gaps at the assembly interface. The interconnection means 121 may preferably be formed from an electrically conductive material that is self-adapting to such minor deviations from flatness when the material and the front and rear cover plates are suitably processed in the heated assembly oven.

Numerous ways to marry the front and rear plates to form an integrated gas panel assembly may be employed. For ease of vendor identification, the processes will be labeled with sub-headings to differentiate the various possibilities.

PROCESS No. 1

In one such self-adapting process (not shown in the drawings) the brazing material or discs 121 may be applied over the via hole conductors 46 in the marginal spacer means 27 with the thickness of the brazing material being thicker than the maximum dimension of the thin gaps between the front cover plate 24 and the marginal spacer means 27 plus the thickness of a solder glass slurry or paste 123 used for sealing purposes. The solder glass and its method of application is discussed herinafter. When the brazing material 12 is softened by the heat of the assembly oven and a light pressure is applied to the front cover plate 24 the softened material deforms between the front cover plate and the marginal spacer means while the material thus self-adapts to provide simultaneous electrical interconnection contacts between the via hole conductors 46 and the terminal ends 44. Simultaneously therewith, the solder glass slurry or paste 123 sinters, coalesces and bonds to form the hermetic seal between the front cover plate 24 and the marginal spacer means 27.

PROCESS No. 2

In another self-adapting process in which the electrically conductive material may have been previously applied over the via hole conductors 46 as screened-on discs 121 (FIG. 16A) the heat of the assembly oven will melt the brazing material. In this process, the plates are heated in a separated condition. Since the areas of the screened-on discs 121 of brazing material are greater than the areas of the via hole conductors 46 surface tension effects causes the volume of the melted or liquid phase brazing material to assume a somewhat spherical shape 122 (FIG. 16B) attached by surface tension wetting effects to the molybdenum or nickel coated molybdenum material of the via hole conductors 46. During the melting process in the heated assembly oven a height dimension $H_1$ of the discs of brazing material 121 (FIG. 16A) may increase to a height dimension $H_2$ of the spherical shapes 122 (FIG. 16B). The volume of the liquid phase brazing material in the spherical shapes 122 may be such that the height dimension $H_2$ may be somewhat greater than the maximum dimension of the thin gaps between the front cover plate 24 and the marginal spacer means 27 plus the thickness of the solder glass 123 used for sealing purposes. Then when the cover plate is assembled under a light pressure to the marginal spacer means the height of the liquid phase brazing material in the spherical shapes 122 bridges across the gaps to contact and wet the terminal ends 44 of the vertical electrodes 42 while any excess of the height dimension $H_2$ of the liquid phase brazing material self-adapts by liquid phase displacement. Once again, as described relative to the first method of forming a completed panel assembly, the solder glass 123 sinters, coalesces and bonds to form a hermatic sealed panel.

PROCESS No. 3

In a preferred self-adapting process the interconnecting means 121 between the via hole conductors 46 in the marginal spacer means 27 and the terminal ends 44 on the rear surface of the front cover plate 24 may be formed in the heated assembly oven concurrently with the assembly of the front cover plate to the marginal spacer means and the forming of the marginal hermetic seal between the front cover plate and the marginal spacer means. For such a concurrent forming process a thin coating of solder glass 123 (FIGS. 14, 16C–16E) may first be applied or screened as a slurry an/or paste onto an area of the rear surface of the front cover plate 24 in a marginal pattern having dimensions which may correspond for subsequent assembly purposes with the area dimensions of the marginal spacer means 27. For explanatory purposes, it should be noted that the solder glass application process is also applicable to FIGS. 16A and 16B as well as the methods above described. The marginal pattern of screened solder glass 123 may have circular apertures 124 (See FIG. 14 and 16A–16F) that expose portions of the terminal ends 44 of the vertical electrodes 42. The apertures 124 may be somewhat larger than the discs of brazing material 121 previously screened on to the marginal spacer means 27. The dimensional locations of the apertures 124 on the rear surface of the front cover plate 24 may align with the dimensional locations of the discs of brazing material 121 on the marginal spacer means 27 for subsequent assembly purposes. The solder glass slurry and/or paste includes particles of solder glass mixed with a volatile vehicle. Additionally, the solder glass may have physical properties for bonding and/or wetting to other glass and/or ceramic surfaces at temperatures below the softening point of the surfaces. Preferably the solder glass becomes softened and/or fluid at a temperature approximately corresponding to the softening and/or fluid temperature of the brazing material such that the solder glass and the brazing material may undergo softening deformation and/or fluid phased deformation in the heated assembly oven at approximately the same temperature. The thickness $S_1$ (FIG. 16A) of the screened solder glass coating 123 should be at least sufficiently greater than the maximum dimension of the thin gaps that may occur between the rear surface of the front cover plate 24 and the marginal spacer means 27 such that when the solder glass particles sinter and coalesce during heating to become a softened and/or fluid phase glass 125 (FIG. 16B) the thickness dimension $S_2$ remaining after the process shrinkage will be at least greater than the thin gaps.

In the self-adapting assembly Process No. 2 the spatial arrangement and alignment of the components for the assembly may appear as shown in FIG. 16A prior to being moved to the heated assembly oven. Assembly fixtures (not shown) having separable alignment and spacing means may be used to maintain the alignment of apertures 124 above the discs of brazing material 121 while a spacing means of the fixture may be used to maintain a space 127 between the solder glass slurry and/or paste 123 and the marginal spacer means 27. After the fixture and the components of the assembly have been moved into the oven and heated the components for the assembly may appear as shown in FIG. 16B with the space 127 having provided access for heat distribution. The volume of the apertures 124 in the heated solder glass 125 may preferably be greater than the volume of the heated brazing material 122 in order to provide space for the deformation of the heated brazing material. The spacer means of fixture may then be removed while the alignment means may be kept in place, and a light pressure applied to the front cover plate 24 to cause the softened and/or fluid phase solder glass 122 to contact and self-adapt to the marginal spacer means 27 to form a hermetic seal between the front cover plate 24 and the marginal spacer means 27 while concurrently the softened and/or liquid phase brazing material 122 may contact and self-adapt to the terminal ends 44 to form electrical interconnections between the via hole conductors 46 and the terminal ends 44. Immediately after removal from the oven the alignment fixture is removed the panel assembly is slowly cooled, the assembly having a structural form as shown in FIG. 16D with the cooled solder glass 125 now providing the hermetic seal 26 and the cooled brazing material 126 now providing the electrical interconnections. The cooled brazing material 126 in FIG. 16D is shown in one self-adapting configuration that may result from its contacting but not wetting the terminal ends 44 when the brazing material was previously softened in the heated assembly oven. However, in a preferred process modification the cooled brazing material 129 in FIG. 16E is shown in a preferred self-adapting configuration that may result from its contacting and wetting the terminal ends 44 when the brazing material is melted in the heated assembly oven.

In the preferred concurrent and self-adapting assembly Process 3 that may not require an assembly fixture the components for the assembly as they appear in FIG. 16A may be brought together and aligned as shown in FIG. 16C prior to being moved to the heated assembly oven. The screened-on slurry and/or paste of solder glass 123 contacts the marginal spacer means 27 and the apertures 124 in the solder glass align with the screened-on discs 121 of brazing material. The height of the discs 121 may preferably be less than the height of the solder glass 123 in order that the solder glass may be in contact with the marginal spacer means 27 prior to heating the components of FIG. 16C in the assembly oven. A weighted plate on top of the front cover plate 24 provides the assembly pressure. Then after being moved into the oven the height $S_1$ (FIG. 16C) of the screened-on layer 123 of solder glass particles gradually decreases to a height $S_2$ (FIG. 16D) as the particles sinter and coalesce to form a self-adapted hermetic seal 26 between the front cover plate 24 and the marginal spacer means 27. concurrently the discs 121 of brazing material melt and increase in height to self-adapt and form electrical interconnections as previously described. The atmosphere within the heated assembly oven may be air, hydrogen or forming gas (about 5 percent mixed with 95 percent nitrogen) but preferably the oven should be constructed in a manner such that the aligned components of FIG. 16C may be heated in the oven in a vacuum. Vacuum heating may improve the reliability of the hermetic seal by substantially eliminating porosity in the seal that otherwise might occasionally occur by trapping of air or gas between particles of the solder glass as the particles sinter and coalesce during heating. After removal from the oven and being slowly cooled the assembled components may have configurations as shown in FIGS. 16D and/or FIG. 16D.

A heated assembly oven may be used for other assembly processes that may be adapted to other configurations of the marginal spacer means. As previously described the other configurations of the marginal spacer means 27 and/or its structural equivalent may be formed fully and/or partially as an integral portion of the front cover plate 24 and/or the rear cover plate 29 prior to the assembly of the cover plates. For these other assembly processes and other configurations the equivalent of the discs 121 of screened-on brazing material may be applied to the front cover plate 24 or the marginal spacer portion thereof and the equivalent of the solder glass slurry and/or paste 123 may be applied to the front surface of the rear cover plate 29 or the marginal spacer portion thereof. In another configuration that may not require the equivalent of a prior formed marginal spacer means 27, a thicker layer of solder glass slurry and/or paste together with thicker discs of brazing material may be suitably applied to the front cover plate 24 and/or the rear cover plate 29. Then after subsequent heating and subsequent slow cooling, the thicker layer of solder glass may provide the combined functions of being an equivalent to a marginal spacer means and a self-adapting hermetically sealing means between the front cover plate 24 and the rear cover plate 29 while the thicker discs of brazing material concurrently provide self-adapting electrical interconnection means between the conductor elements of the front and rear cover plates. Also as previously described a structural equivalent of the marginal spacer means 27 may be a suitably formed separate piece of glass or ceramic material that is positioned between the front cover plate 24 and the rear cover plate 29 prior to heating. In this instance the solder glass slurry may be applied to both sides of the separate piece and/or to the front cover plate 24 and the rear plate 29 for sealing purposes.

In still other applications of the concurrent self-adapting hermetic sealing and electrical interconnection processes, one multilayer ceramic substrate may be assembled to another multilayer ceramic substrate in a heated assembly oven. For example, the circuit layout designer and manufacturing engineering personnel may determine that higher product yields or other useful objectives may be obtained by stacking, laminating, sintering, and inspecting layers 29A to 29M (with or without the marginal spacer means 27) separately from the layers 29N to 29Z, i.e. in two or more sections. Then such substrates 29A–29M and 29N–29Z as may have passed inspection acceptance may have a layer of solder glass slurry and/or paste screened with suitable apertures for electrical interconnections applied to the rear surface of the substrate 29A–29M and discs of brazing material may be screened over the via hole conductors on the front surfaces of the substrate 29N–29Z. Note that in this application the interconnections may be made at any convenient location on the front and rear surfaces of suitable layers and are not restricted to marginal areas. After subsequent heating in the assembly oven and subsequent slow cooling the substrate 29A–29M and 29M–29Z may now become an integral multilayer ceramic structure 29 having hermetically sealed electrical interconnections between the electrically conductive elements within the substrates. In a similar process application the solder glass slurry and/or past may equivalently be applied to the front surface of the substrate 29N–29Z and the discs of brazing material may be applied over via hole conductors and/or circuit line conductors on the rear surface of the substrate 29A–29M without significantly affecting the functions and/or objectives of the assembly process or the product.

To prepare the assembled structure of the front cover plate 24 and the rear cover plate 29 (FIGS. 3B, 3C) and the gas chamber 28 between the plates for charging with a low pressure mixture of neon and argon gases a length of glass tubing 36 may be attached to the rear surface of the rear cover plate 29 by using a heated oven and solder glass for attaching and bonding purposes. The base of the tubing may be centered over an aperture 37 through the rear cover plate 29 that may provide a continuous communicating gas passageway to the gas chamber 28. The assembly may then be placed in a heated processing oven and the glass tubing 36 suitably connected with commercially available apparatus (not shown) for purposes of evacuating and recharging the gas chamber 28. After the assembly has been heated for several hours at its bake out temperature while the apparatus and the glass tubing apply a high vacuum to the gas chamber, substantially all occluded and/or absorbed gas may be out-gassed from the gas chamber 28 and the interior surfaces of the gas chamber. The apparatus then recharges the gas chamber 28 through the tube 36 with a low pressure mixture of neon gas that includes a small percentage of argon gas. Other mixtures of gases may be used when an ionized color spectrum other than neon red may be required for display purposes. The tube 36 may then be heated near the rear cover plate 29 and pinched-off to provide a hermetic seal.

After removal-from the heated processing oven the assembled structure may be cooled and then placed in suitable electrical testing and inspecting fixture (not shown).

Figure 5A:
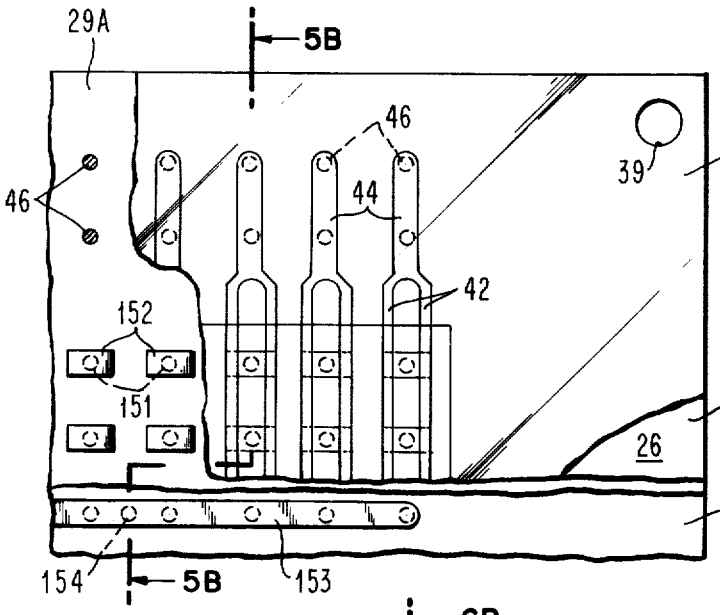
FIG. 5A is an enlarged fragmentary sectional view of an alternate embodiment of the invention and similar to the view of the panel shown in FIG. 4A.
Figure 5B:
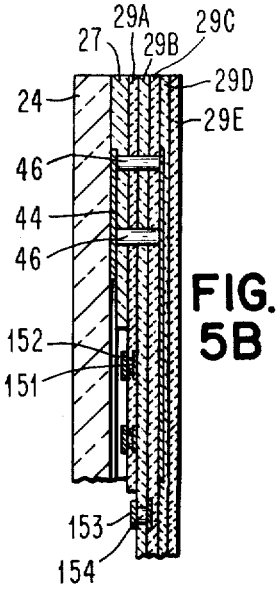
FIG. 5B is a fragmentary sectional view taken along line 5B—5B of FIG. 5A.

It should be recognized that the previously described constructural and processing means such as may have been used for an assembled gas display panel configuration may be used for other gas display panel configurations. For example, an other gas discharge display panel configuration such as is shown in FIGS. 5A–5B may be somewhat similar to the configuration shown in FIGS. 4A–4E except for some of the differences hereinafter described. Likewise it should be understood that the constructural, processing, and functional features previously described relative to FIGS. 1A to 4E and 6A to 16E may be used with the configuration shown in FIGS. 5A–5B where applicable and/or convenient. To avoid confusion, identical reference numbers have been used in FIGS. 5A–5B and FIGS. 4A–4E for such items as may be essentially similar and/or common to both configurations.

The multilayer rear cover plate 29 with its internal electrical interconnections as shown in FIGS. 5A–5B provides a unique means for electrically energizing small discrete electrodes such as 151 located on the front surface of the rear cover plate 29. The discrete electrodes 151 may preferably be small rectangles arranged in horizontal rows across the gas chamber 28 from right to left. The horizontal rows of discrete horizontal electrodes may extend in multiple rows across the gas chamber 28 from top to bottom. The discrete electrodes 151 are hereinafter called "discrete horizontal electrodes" to differentiate them from the linear form of the horizontal electrodes 43 of FIGS. 4A–4E.

The discrete horizontal electrodes 151 may be formed of electrically conductive material applied to the front surface of layer 29A of the multilayer rear cover plate 29 by one or more suitable processes such as have been previously described for applying the metallized horizontal electrodes 43 of FIGS. 4A–4E. The discrete horizontal electrodes 151 and the front surface of the rear cover plate 29 may be coated with a thin film of dielectric glass and overcoated with a thin film of magnesium oxide as previously described for the horizontal electrodes 43 of FIGS. 4A–4E. The discrete horizontal electrodes 151 may be intervally spaced horizontally along each horizontal row across the gas chamber 28 to align with and cooperate with multiple vertical electrode pairs such as 42 on the rear surface of the front cover plate 24 for gas discharge purposes. Thus a matrix of ionizable gas cells may be formed at the intersections of the multiple vertical electrode pairs 42 with the multiple horizontal rows of discrete horizontal electrodes 151. The matrix of ionizable gas cells may be distributed over substantially all of the visible area of the gas chamber 28. When energized by suitably programmed electrical voltages, combinations of gas cells within the matrix may become visibly ionized to display alpha-numeric characters, etc. within the viewing area.

Electrical circuit means are provided for simultaneously energizing all the discrete horizontal electrodes 151 in any one horizontal row. For such simultaneous energizing purposes horizontal rows of individual via hole conductors such as 152 are formed through layer 29A. The individual via hole conductors 152 of each row are located under each discrete horizontal electrode 151 and provide electrical interconnections between the electrodes 151 and internal horizontal conductor lines such as 153 on layer 29B. The internal horizontal conductor lines 153 are preferably arranged in a horizontal lattice in which the individual horizontal conductor lines 153 of the lattice are aligned with and under each horizontal row of discrete horizontal electrodes 151. Individual internal via hole conductors such as 154 through one or more internal layers such as layer 29B may be used to provide internal electrical interconnections between the individual internal horizontal conductor lines 153 and other individual internal electrical circuit elements such as 156. Thus with the above described electrical conductor circuitry suitable programmed electrical energization voltages provided by other circuit elements of the display panel assembly may be selectively applied to individual circuit elements such as 156, individual internal via hole conductors such as 154, individual horizontal conductor lines such as 153, one row of via hole conductors such as 152, and simultaneously excite one row of discrete horizontal electrodes such as 151.

The principal advantage of the structure illustrated in FIG. 5A and 5B is the increased inhibition for inadvertent adjacent electrode ionization between adjacent gas cells of a horizontal row of gas cells. Further, the discrete array provides for a more crisp definition.

As described in previous paragraphs several different processes may have been used heretofore to prepare the rear surface of the multilayer ceramic rear cover plate 24 (FIGS. 11A, 11B, 12A, 12B) for the assembly of the contiguous electrical component packages 86, the electronic substrates 87, the hermetic enclosure 94 and the external terminal pins 34. In the event that the external terminal pins 34 may not have been previously assembled to the rear cover plate 24 and the via hole conductors 98 they may now be assembled at this step of the processing sequence by using a locating fixture, suitable brazing or soldering material, and a heated processing oven. Likewise, in the event that the remaining exposed via hole conductors, the metallized band 93, and the external terminal pins 34 may not have been previously prepared they may now be coated, first with a thin film of nickel followed by a thin film of gold, preferably by using electroless plating baths.

In the next assembly operation the rear surface of the rear cover plate 29 may be oriented horizontally and facing upwards. In this orientation a light coating of rosin may be applied to the exposed via hole conductors. The electrical component packages 86 and the electrical substrates 87 may now be positioned on the rear surface of the rear cover plate with their respective interconnection solder pads such as 88 and 89 suitably aligned for forming interconnections with corresponding via hole conductors on the rear surface of the rear cover plate. This assembly may now be moved into a heated process oven where the solder pads such as 88 and 89 may melt and reflow to form mechanical supports and electrical interconnections for the electrical component packages 86 and the electronic substrates 87 to the via hole conductors on the rear surface of the rear cover plate. After removal from the oven, cooling and cleaning, the assembly may be placed in a testing and inspection fixture that makes electrical connections with the external terminal pins 34. By applying suitable electrical power and programmed signals to the external terminal pins 34 the testing fixture may electrically exercise the assembled structure causing it to display visible alpha-numeric characters of ionized gas for inspection acceptance purposes. In the event that the inspection of the visible display may reveal that defective electrical component packages 88 or electronic substrate 89 may have inadvertently been included in the assembly the defective item may be removed by heating and melting the solder pads and then replacing it with another item by repeating the above described process sequence.

The hermetic enclosure 94 for the electrical substrates 87 may be soft-soldered to the rear surface of the rear cover plate 29. The volume interior to the hermetic enclosure 94 may preferably be charged with dry nitrogen through a charging aperture 131 that may subsequently sealed with soft-solder 132. Alternately, the interior to the hermetic enclosure 94 may be charged and sealed to contain a fluid to assist in heat dissipation from the electrical components packages 86 and the electronic substrates 87.

Finally the power and signal cable 23 (FIG. 2) may be connected to the external terminal pins 34 and the contiguous display panel may be mounted in the small housing 19. After several hours of electrical exercising and a final inspection the completed display panel assembly may be packed in a shipping carton and moved to warehouse inventory.

Although the invention has been described with a certain degree of particularity, it is understood that the present disclosure has been made only by way of example and that numerous changes in the details of construction and the combination and arrangement of parts may be made without departing from the spirit and the scope of the invention as hereinafter claimed.

What is claimed is:

1. A gas discharge display panel having front and rear cover plates with transversely intersecting confronting electrodes in spaced apart relation therebetween, at least said electrodes associated with said rear cover plate being positioned on one outer surface of said rear cover plate; said rear cover plate including a plurality of discrete layers of nonconductive material with conductors extending therethrough and connecting said electrodes; and means defining a hermetically sealed gas filled chamber intermediate said plates at least between said electrodes.

2. A gas discharge display panel in accordance with claim 1 wherein said rear cover plate comprises multiple layers of ceramic sheets.

3. A gas discharge display panel in accordance with claim 1 including terminations of said conductors externally of said layers, and active circuit means connected to at least some of said terminations, and means for connecting a source of power to at least other of said terminations.

4. A gas discharge display panel in accordance with claim 3 including cover means hermetically sealing and overlying said active circuit means.

5. A gas discharge display panel in accordance with claim 4 wherein said terminations for receiving a source of power are positioned remote from said cover means.

6. A gas discharge display panel in accordance with claim 1 including a plurality of other conductors in said layers and connected to said electrodes and said first mentioned conductors, said other conductors forming redundant pairs with at least some of said electrodes.

7. A gas discharge display panel comprising:

a. A front cover plate having a front surface and a rear surface, a marginal sealing area extending adjacent to and about the periphery of said rear surface of said plate, said marginal sealing area enclosing a viewing area therewithin, b. A rear cover plate comprised of contiguous layers of nonconductive material, said rear cover plate having a front surface and a rear surface, a marginal sealing area extending adjacent to and about the periphery of said front surface, and means hermetically sealing said marginal sealing areas at least one to the other;

c. Means defining a chamber for containing ionizable gas, said chamber intermediate said plates and said marginal sealing area;

d. Multiple electrodes on the rear surface of said front cover plate, each having at least one terminal end in the marginal sealing area of said front cover plate;

e. Multiple electrodes on the front surface of said rear cover plate spaced from said conductors on the rear surface of said front cover plate, f. Conductive means extending from at least one of said layers of said rear cover plate to said electrodes on the rear surface of said front cover plate, and g. Means for making electrical connections to said conductive means externally of said rear cover plate.

8. A gas discharge display panel in accordance with claim 7 wherein said front cover plate includes a transparent portion defining a display area.

9. A gas discharge display panel in accordance with claim 7 wherein said multiple electrodes on the rear surface of said front cover plate have at least one terminal end in said marginal sealing area of said front cover plate, and a hermetic seal of said marginal sealing areas at least one to the other.

10. A gas discharge display panel in accordance with claim 7 wherein said multiple electrodes on said rear surface of said front cover plate include multiple pairs of spaced electrical conductors, each pair of electrical conductors having a common terminal end in said marginal sealing area of said front cover plate.

11. A gas discharge display panel in accordance with claim 10 wherein said common terminal ends are hermetically sealed in said marginal sealing area.

12. A gas discharge display panel in accordance with claim 7 wherein said conductive means extending from at least one of said layers of said rear cover plate to said multiple electrodes on the rear surface of said front cover plate are hermetically sealed in and through said marginal sealing area.

13. A gas discharge display panel in accordance with claim 12 wherein said conductive means is hermetically sealed from the atmosphere and from said gas chamber.

14. A gas discharge display panel in accordance with claim 7 wherein said conductive means extends from at least one of said layers of said rear cover plate to said terminal ends of said multiple electrodes on the rear surface of said front cover plate and said conductive means is hermetically sealed in and through at least one of said marginal sealing areas.

15. A gas discharge display panel in accordance with claim 14 wherein said conductive means is hermetically sealed from the atmosphere and is hermetically sealed from said gas chamber.

16. A gas discharge display panel in accordance with claim 7 wherein at least a portion of said front cover plate is glass.

17. A gas discharge display panel in accordance with claim 7 wherein said rear cover plate comprises a multilayer ceramic material.

18. A gas discharge display panel in accordance with claim 7 wherein said rear cover plate comprises a multilayer ceramic material which is bonded together to form an integral structure.

19. A gas discharge display panel in accordance with claim 7 wherein said electrodes on said front of said cover plate comprise a plurality of rectangular conductors arranged in rows and columns.

20. In a gas discharge display panel having front and rear plates adapted for hermetic sealing about the periphery thereof, means defining a gas filled chamber between said plates, the improvement in said rear cover plate comprising: a plurality of contiguous, insulating gas impervious layers; said plate including a front surface and a rear surface, and electrical conductors within said plurality of layers; discrete gas ionizing electrodes on said front surface of said plate; conducting means connecting said internal electrical conductors to said discrete gas ionizing electrodes, said conducting means extending through at least one of said plurality of layers.

21. In a gas discharge display panel in accordance with claim 20 including conductor terminations on said rear surface of said plate.

22. In a gas discharge display panel in accordance with claim 21 including active electronic devices connected to said terminations.

23. In a gas discharge display panel in accordance with claim 22 including a cover member overlying said active devices and hermetically sealing said devices to said rear plate.

24. A gas discharge display panel comprising: a first cover plate having front and rear major surfaces, a second cover plate comprised of contiguous, superimposed, abutting, gas impervious, insulating layers, said second cover plate having first and second major surfaces; a sealing area on each of said first and second plates and adapted for confronting sealing relationship with each other; and a marginal spacer intermediate said sealing areas and hermetically bonded intermediate said sealing area; said marginal spacer defining a chamber intermediate said first and second plates for containing an ionizable gas; a first set of electrodes in said chamber on one of said plates, and a second set of electrodes transverse to said electrodes, in said chamber and on said other plates; at least some of the terminal ends of said conductors being positioned in said sealing area, and electrical conductive means extending from at least one of said layers of said second plate to said conductors on said one cover plate, and means externally of said second cover plate for making electrical connections to said electrical conductive means.

25. A gas discharge display panel in accordance with claim 24 wherein one of said sets of electrodes comprises a plurality of rectangular conductors arranged in columns and rows.

26. A gas discharge display panel in accordance with claim 24 including a lattice of conductors in one of said layers paralleling said electrodes and connected thereto, to thereby form redundant pairs.

27. A gas discharge display panel in accordance with claim 26, including means in said marginal seal for connecting said electrodes to said lattice.

* * * * *